US011257417B2

(12) United States Patent
Yim et al.

(10) Patent No.: US 11,257,417 B2
(45) Date of Patent: Feb. 22, 2022

(54) METHOD OF GENERATING CORRECTION DATA FOR DISPLAY DEVICE, AND DISPLAY DEVICE STORING CORRECTION DATA

(71) Applicant: Samsung Display Co., Ltd., Yongin-Si (KR)

(72) Inventors: Hyungwoo Yim, Hwaseong-si (KR); Juneyoung Lee, Seoul (KR); Jae-Seob Chung, Asan-si (KR); Hoisik Moon, Hwaseong-si (KR)

(73) Assignee: SAMSUNG DISPLAY CO., LTD., Gyeonggi-do (KR)

( * ) Notice: Subject to any disclaimer, the term of this patent is extended or adjusted under 35 U.S.C. 154(b) by 47 days.

(21) Appl. No.: 16/710,164

(22) Filed: Dec. 11, 2019

(65) Prior Publication Data

US 2020/0219433 A1 Jul. 9, 2020

(30) Foreign Application Priority Data

Jan. 8, 2019 (KR) ..... 10-2019-0002442

(51) Int. Cl.
*G09G 3/20* (2006.01)

(52) U.S. Cl.
CPC ..... *G09G 3/2044* (2013.01); *G09G 2310/027* (2013.01); *G09G 2320/0233* (2013.01); *G09G 2360/16* (2013.01)

(58) Field of Classification Search
CPC ..... G09G 3/2044; G09G 2310/027; G09G 2320/0233; G09G 2360/16
See application file for complete search history.

(56) References Cited

U.S. PATENT DOCUMENTS 9,721,530 B2 8/2017 Han et al.
9,940,883 B2 4/2018 Han et al.
2009/0262114 A1* 10/2009 Park ..... H04N 9/69 345/440
2015/0348505 A1* 12/2015 Pyo ..... G09G 3/2003 345/589

(Continued)

FOREIGN PATENT DOCUMENTS

KR 1020140093011 A 7/2014
KR 1020150030013 A 3/2015

(Continued)

*Primary Examiner* — Stephen G Sherman
(74) *Attorney, Agent, or Firm* — Cantor Colburn LLP

(57) ABSTRACT

In a method of generating correction data for a display device, measured tristimulus data at a maximum gray level are obtained, measured luminance and color coordinate profiles are obtained based on the measured tristimulus data, a target color coordinate profile is determined based on the measured color coordinate profile, measured red, green and blue maximum luminances of each pixel are obtained, a maximum target luminance of the each pixel is determined such that red, green and blue luminances of the each pixel become lower than or equal to the measured red, green and blue maximum luminances, respectively, a final target luminance profile is determined based on the measured luminance profile and the maximum target luminance of the each pixel, and correction data may be generated and stored in the display device based on the final target luminance profile and the target color coordinate profile.

17 Claims, 10 Drawing Sheets

(56) References Cited

U.S. PATENT DOCUMENTS

2016/0125787 A1* 5/2016 Pyeon ..... G09G 3/2055
345/691

FOREIGN PATENT DOCUMENTS

KR 1020170002770 A 1/2017
KR 1020170106527 A 9/2017
KR 101784216 B1 10/2017

* cited by examiner

METHOD OF GENERATING CORRECTION DATA FOR DISPLAY DEVICE, AND DISPLAY DEVICE STORING CORRECTION DATA

This application claims priority to Korean Patent Application No. 10-2019-0002442, filed on Jan. 8, 2019, and all the benefits accruing therefrom under 35 U.S.C. § 119, the content of which in its entirety is herein incorporated by reference.

BACKGROUND

1. Field

Exemplary embodiments of the invention relate to display devices, and more particularly to methods of generating correction data for display devices, and display devices storing correction data.

2. Description of the Related Art

Even when a plurality of pixels included in a display device is manufactured by the same process, the plurality of pixels may have different luminances and different color coordinates due to a process variation, or the like, and thus a luminance mura defect and/or a color mura defect may occur in the display device. To reduce or eliminate the luminance and/or color mura defects, and to improve luminance and/or color coordinate uniformity of the display device, an image displayed by the display device in a module state may be captured, correction data may be generated based on the captured image, and the correction data may be stored in the display device. The display device may correct image data based on the stored correction data, and may display an image based on the corrected image data, thereby displaying the image with uniform luminance and/or uniform color coordinate and without the luminance and/or color mura defects.

SUMMARY

With respect to a maximum gray level (e.g., a 255 gray level) representable by a display device, since the display device cannot display an image corresponding to a gray level higher than the maximum gray level, correction data for correcting the luminance and/or color mura defects cannot be generated, and thus the luminance and/or color mura defects at the maximum gray level of the display device may not be corrected.

Some exemplary embodiments provide a method of generating correction data for a display device capable of generating the correction data at a maximum gray level.

Some exemplary embodiments provide a display device capable of correcting luminance and/or color mura defects at a maximum gray level.

An exemplary embodiment provides a method of generating correction data for a display device. In the method, measured tristimulus data of the display device at a maximum gray level are obtained, a measured luminance profile and a measured color coordinate profile of the display device at the maximum gray level are obtained based on the measured tristimulus data at the maximum gray level, a target color coordinate profile of the display device at the maximum gray level is determined based on the measured color coordinate profile, a measured red maximum luminance, a measured green maximum luminance and a measured blue maximum luminance of each pixel in the display device are obtained, a maximum target luminance of the each pixel is determined such that a red luminance, a green luminance and a blue luminance of the each pixel converted from the maximum target luminance and a target color coordinate of the each pixel at the maximum gray level become lower than or equal to the measured red maximum luminance, the measured green maximum luminance and the measured blue maximum luminance of the each pixel, respectively, a final target luminance profile of the display device at the maximum gray level is determined based on the measured luminance profile and the maximum target luminance of the each pixel, and the correction data at the maximum gray level are stored in the display device by generating the correction data at the maximum gray level based on the final target luminance profile and the target color coordinate profile at the maximum gray level.

In an exemplary embodiment, the correction data at the maximum gray level may have correction values lower than or equal to 0.

In an exemplary embodiment, white maximum gray data are provided to the display device, and the measured tristimulus data at the maximum gray level may be obtained by capturing a white image displayed by the display device based on the white maximum gray data.

In an exemplary embodiment, to obtain the measured luminance profile and the measured color coordinate profile at the maximum gray level, the measured tristimulus data at the maximum gray level may be converted to luminance and color coordinate data in a luminance and color coordinate domain, the measured luminance profile may be obtained based on luminance data among the luminance and color coordinate data, a measured x-color coordinate profile may be obtained based on x-color coordinate data among the luminance and color coordinate data, and a measured y-color coordinate profile may be obtained based on y-color coordinate data among the luminance and color coordinate data.

In an exemplary embodiment, to determine the target color coordinate profile at the maximum gray level, a target x-color coordinate profile may be determined by calculating a moving average for the measured x-color coordinate profile, and a target y-color coordinate profile may be determined by calculating a moving average for the measured y-color coordinate profile.

In an exemplary embodiment, red maximum gray data may be provided to the display device, the measured tristimulus data at a red maximum gray level may be obtained by capturing a red image displayed by the display device based on the red maximum gray data, the measured red maximum luminance of the each pixel may be obtained from the measured tristimulus data at the red maximum gray level, green maximum gray data may be provided to the display device, the measured tristimulus data at a green maximum gray level may be obtained by capturing a green image displayed by the display device based on the green maximum gray data, the measured green maximum luminance of the each pixel may be obtained from the measured tristimulus data at the green maximum gray level, blue maximum gray data may be provided to the display device, the measured tristimulus data at a blue maximum gray level may be obtained by capturing a blue image displayed by the display device based on the blue maximum gray data, and the measured blue maximum luminance of the each pixel may be obtained from the measured tristimulus data at the blue maximum gray level.

In an exemplary embodiment, to determine the maximum target luminance of the each pixel, target luminance and color coordinate data of the each pixel may be obtained by setting the maximum target luminance of the each pixel to a variable a and by obtaining the target color coordinate of the each pixel from the target color coordinate profile, the target luminance and color coordinate data of the each pixel may be converted to target tristimulus data of the each pixel, the target tristimulus data of the each pixel may be converted to the red luminance, the green luminance and the blue luminance of the each pixel by an XYZ-to-YrYgYb conversion matrix, and the variable a may be determined such that the red luminance, the green luminance and the blue luminance of the each pixel become lower than or equal to the measured red maximum luminance, the measured green maximum luminance and the measured blue maximum luminance of the each pixel, respectively.

In an exemplary embodiment, the XYZ-to-YrYgYb conversion matrix may be $$\begin{bmatrix} \frac{W_{xR}}{W_{yR}} & \frac{W_{xG}}{W_{yG}} & \frac{W_{xB}}{W_{yB}} \\ 1 & 1 & 1 \\ \frac{W_{zR}}{W_{yR}} & \frac{W_{zG}}{W_{yG}} & \frac{W_{zB}}{W_{yB}} \end{bmatrix}^{-1},$$

where $W_{xR}$ represents an x-color coordinate value of a red image of the each pixel, $W_{yR}$ represents a y-color coordinate value of the red image of the each pixel, $W_{zR}$ is calculated by subtracting the x-color coordinate value and the y-color coordinate value of the red image of the each pixel from 1, $W_{xG}$ represents an x-color coordinate value of a green image of the each pixel, $W_{yG}$ represents a y-color coordinate value of the green image of the each pixel, $W_{zG}$ is calculated by subtracting the x-color coordinate value and the y-color coordinate value of the green image of the each pixel from 1, $W_{xB}$ represents an x-color coordinate value of a blue image of the each pixel, $W_{yB}$ represents a y-color coordinate value of the blue image of the each pixel, and $W_{zB}$ is calculated by subtracting the x-color coordinate value and the y-color coordinate value of the blue image of the each pixel from 1.

In an exemplary embodiment, the maximum target luminance of the each pixel may be determined using an equation:

$$\begin{bmatrix} \frac{W_{xR}}{W_{yR}} & \frac{W_{xG}}{W_{yG}} & \frac{W_{xB}}{W_{yB}} \\ 1 & 1 & 1 \\ \frac{W_{zR}}{W_{yR}} & \frac{W_{zG}}{W_{yG}} & \frac{W_{zB}}{W_{yB}} \end{bmatrix}^{-1} \begin{bmatrix} \frac{W_{x'255}}{W_{y'255}} \cdot \alpha \\ \alpha \\ \frac{W_{z'255}}{W_{y'255}} \cdot \alpha \end{bmatrix} \leq \begin{bmatrix} Y_{R255} \\ Y_{G255} \\ Y_{B255} \end{bmatrix},$$

where $\alpha$ represents the maximum target luminance of the each pixel, $W_{x'255}$ represents an x-color coordinate value of the target color coordinate of the each pixel, $W_{y'255}$ represents a y-color coordinate value of the target color coordinate of the each pixel, $W_{z'255}$ is calculated by subtracting the x-color coordinate value and the y-color coordinate value of the target color coordinate of the each pixel from 1, $Y_{R255}$ represents the measured red maximum luminance, $Y_{G255}$ represents the measured green maximum luminance, $Y_{B255}$ represents the measured blue maximum luminance, $W_{xR}$ represents an x-color coordinate value of a red image of the each pixel, $W_{yR}$ represents a y-color coordinate value of the red image of the each pixel, $W_{zR}$ is calculated by subtracting the x-color coordinate value and the y-color coordinate value of the red image of the each pixel from 1, $W_{xG}$ represents an x-color coordinate value of a green image of the each pixel, $W_{yG}$ represents a y-color coordinate value of the green image of the each pixel, $W_{zG}$ is calculated by subtracting the x-color coordinate value and the y-color coordinate value of the green image of the each pixel from 1, $W_{xB}$ represents an x-color coordinate value of a blue image of the each pixel, $W_{yB}$ represents a y-color coordinate value of the blue image of the each pixel, and $W_{zB}$ is calculated by subtracting the x-color coordinate value and the y-color coordinate value of the blue image of the each pixel from 1.

In an exemplary embodiment, an intermediate target luminance profile may be determined by calculating a moving average for the measured luminance profile at the maximum gray level, and the final target luminance profile at the maximum gray level may be determined by adjusting the intermediate target luminance profile to become lower than or equal to the maximum target luminance of the each pixel.

In an exemplary embodiment, a target red luminance, a target blue luminance and a target green luminance of the each pixel may be calculated based on the final target luminance profile and the target color coordinate profile at the maximum gray level, a target red gray level, a target green gray level and a target blue gray level respectively corresponding to the target red luminance, the target blue luminance and the target green luminance of the each pixel may be obtained, and a value generated by subtracting a maximum red gray level from the target red gray level, a value generated by subtracting a maximum green gray level from the target green gray level and a value generated by subtracting a maximum blue gray level from the target blue gray level may be stored as the correction data at the maximum gray level in the display device.

In an exemplary embodiment, the final target luminance profile at at least one reference gray level lower than the maximum gray level may be obtained by applying a reduction ratio of an average of the final target luminance profile at the maximum gray level to an average of the measured luminance profile at the maximum gray level to an intermediate target luminance profile at the at least one reference gray level, and the correction data at the at least one reference gray level may be stored in the display device by generating the correction data at the at least one reference gray level based on the final target luminance profile at the at least one reference gray level.

In an exemplary embodiment, the measured tristimulus data at the at least one reference gray level may be obtained by capturing an image at the at least one reference gray level lower than the maximum gray level displayed by the display device, the measured luminance profile and the measured color coordinate profile at the at least one reference gray level may be obtained based on the measured tristimulus data at the at least one reference gray level, and the intermediate target luminance profile at the at least one reference gray level may be determined by calculating a moving average for the measured luminance profile at the at least one reference gray level and the target color coordinate profile at the at least one reference gray level by calculating a moving average for the measured color coordinate profile at the at least one reference gray level. The correction data at the at least one reference gray level may be determined based on the final target luminance profile and the target color coordinate profile at the at least one reference gray level.

An exemplary embodiment provides a display device including a display panel including pixels, a correction data memory which stores correction data at a plurality of reference gray levels including a maximum gray level, a data corrector which corrects image data based on the correction data, a controller which performs a dithering operation based on the corrected image data to output dithered image data, and a data driver which generates data signals based on the dithered image data output from the controller, and provides the data signals to the pixels. The correction data at the maximum gray level have correction values lower than or equal to 0.

In an exemplary embodiment, measured tristimulus data of the display device at the maximum gray level may be obtained by capturing a white image at the maximum gray level displayed by the display device, a measured luminance profile and a measured color coordinate profile of the display device at the maximum gray level may be obtained based on the measured tristimulus data at the maximum gray level, a target color coordinate profile of the display device at the maximum gray level may be determined based on the measured color coordinate profile, a measured red maximum luminance, a measured green maximum luminance and a measured blue maximum luminance of each pixel in the display device may be obtained, a maximum target luminance of the each pixel may be determined such that a red luminance, a green luminance and a blue luminance of the each pixel converted from the maximum target luminance and a target color coordinate of the each pixel at the maximum gray level become lower than or equal to the measured red maximum luminance, the measured green maximum luminance and the measured blue maximum luminance of the each pixel, respectively, a final target luminance profile of the display device at the maximum gray level may be determined based on the measured luminance profile and the maximum target luminance of the each pixel, and the correction data at the maximum gray level may be generated based on the final target luminance profile and the target color coordinate profile at the maximum gray level.

In an exemplary embodiment, target luminance and color coordinate data of the each pixel may be obtained by setting the maximum target luminance of the each pixel to a variable a and by obtaining the target color coordinate of the each pixel from the target color coordinate profile, the target luminance and color coordinate data of the each pixel may be converted to target tristimulus data of the each pixel, the target tristimulus data of the each pixel may be converted to the red luminance, the green luminance and the blue luminance of the each pixel by an XYZ-to-YrYgYb conversion matrix, and the variable a may be determined such that the red luminance, the green luminance and the blue luminance of the each pixel become lower than or equal to the measured red maximum luminance, the measured green maximum luminance and the measured blue maximum luminance of the each pixel, respectively.

In an exemplary embodiment, the XYZ-to-YrYgYb conversion matrix may be:

$$\begin{bmatrix} \frac{W_{xR}}{W_{yR}} & \frac{W_{xG}}{W_{yG}} & \frac{W_{xB}}{W_{yB}} \\ 1 & 1 & 1 \\ \frac{W_{zR}}{W_{yR}} & \frac{W_{zG}}{W_{yG}} & \frac{W_{zB}}{W_{yB}} \end{bmatrix}^{-1},$$

where $W_{xR}$ represents an x-color coordinate value of a red image of the each pixel, $W_{yR}$ represents a y-color coordinate value of the red image of the each pixel, $W_{zR}$ is calculated by subtracting the x-color coordinate value and the y-color coordinate value of the red image of the each pixel from 1, $W_{xG}$ represents an x-color coordinate value of a green image of the each pixel, $W_{yG}$ represents a y-color coordinate value of the green image of the each pixel, $W_{zG}$ is calculated by subtracting the x-color coordinate value and the y-color coordinate value of the green image of the each pixel from 1, $W_{xB}$ represents an x-color coordinate value of a blue image of the each pixel, $W_{yB}$ represents a y-color coordinate value of the blue image of the each pixel, and $W_{zB}$ is calculated by subtracting the x-color coordinate value and the y-color coordinate value of the blue image of the each pixel from 1.

In an exemplary embodiment, the maximum target luminance of the each pixel may be determined using an equation:

$$\begin{bmatrix} \frac{W_{xR}}{W_{yR}} & \frac{W_{xG}}{W_{yG}} & \frac{W_{xB}}{W_{yB}} \\ 1 & 1 & 1 \\ \frac{W_{zR}}{W_{yR}} & \frac{W_{zG}}{W_{yG}} & \frac{W_{zB}}{W_{yB}} \end{bmatrix}^{-1} \begin{bmatrix} \frac{W_{x'255}}{W_{y'255}} \cdot \alpha \\ \alpha \\ \frac{W_{z'255}}{W_{y'255}} \cdot \alpha \end{bmatrix} \leq \begin{bmatrix} Y_{R255} \\ Y_{G255} \\ Y_{B255} \end{bmatrix},$$

where $\alpha$ represents the maximum target luminance of the each pixel, $W_{x'255}$ represents an x-color coordinate value of the target color coordinate of the each pixel, $W_{y'255}$ represents a y-color coordinate value of the target color coordinate of the each pixel, $W_{z'255}$ is calculated by subtracting the x-color coordinate value and the y-color coordinate value of the target color coordinate of the each pixel from 1, $Y_{R255}$ represents the measured red maximum luminance, $Y_{G255}$ represents the measured green maximum luminance, $Y_{B255}$ represents the measured blue maximum luminance, $W_{xR}$ represents an x-color coordinate value of a red image of the each pixel, $W_{yR}$ represents a y-color coordinate value of the red image of the each pixel, $W_{zR}$ is calculated by subtracting the x-color coordinate value and the y-color coordinate value of the red image of the each pixel from 1, $W_{xG}$ represents an x-color coordinate value of a green image of the each pixel, $W_{yG}$ represents a y-color coordinate value of the green image of the each pixel, $W_{zG}$ is calculated by subtracting the x-color coordinate value and the y-color coordinate value of the green image of the each pixel from 1, $W_{xB}$ represents an x-color coordinate value of a blue image of the each pixel, $W_{yB}$ represents a y-color coordinate value of the blue image of the each pixel, and $W_{zB}$ is calculated by subtracting the x-color coordinate value and the y-color coordinate value of the blue image of the each pixel from 1.

In an exemplary embodiment, the correction data may include a plurality of correction values at a plurality of sampling positions, and, with respect to each pixel, the data corrector may correct the image data for the each pixel by performing a bilinear interpolation on the plurality of correction values at four sampling points adjacent to the each pixel among the plurality of sampling positions.

In an exemplary embodiment, with respect to each pixel, the data corrector may correct the image data for the each pixel by performing a linear interpolation on the plurality of correction values at two reference gray levels adjacent to a gray level of the image data for the each pixel among the plurality of reference gray levels.

As described above, in a method of generating correction data for a display device in exemplary embodiments, a maximum target luminance of each pixel may be determined such that a red luminance, a green luminance and a blue luminance of the each pixel converted from the maximum target luminance and a target color coordinate of the each pixel at a maximum gray level may become lower than or equal to a measured red maximum luminance, a measured green maximum luminance and a measured blue maximum luminance, respectively, and a final target luminance profile of the display device at the maximum gray level may be determined based on a measured luminance profile and the maximum target luminance of the each pixel. Accordingly, the correction data may be generated at the maximum gray level, and the display device may perform luminance mura correction and/or color mura correction at the maximum gray level based on the correction data.

Further, the display device in exemplary embodiments may store the correction data at a plurality of reference gray levels including the maximum gray level, and the correction data at the maximum gray level may have correction values less than or equal to 0. Accordingly, the display device may perform the luminance mura correction and/or the color mura correction at the maximum gray level based on the correction data.

BRIEF DESCRIPTION OF THE DRAWINGS

Illustrative, non-limiting exemplary embodiments will be more clearly understood from the following detailed description in conjunction with the accompanying drawings.

DETAILED DESCRIPTION

Figure 1:
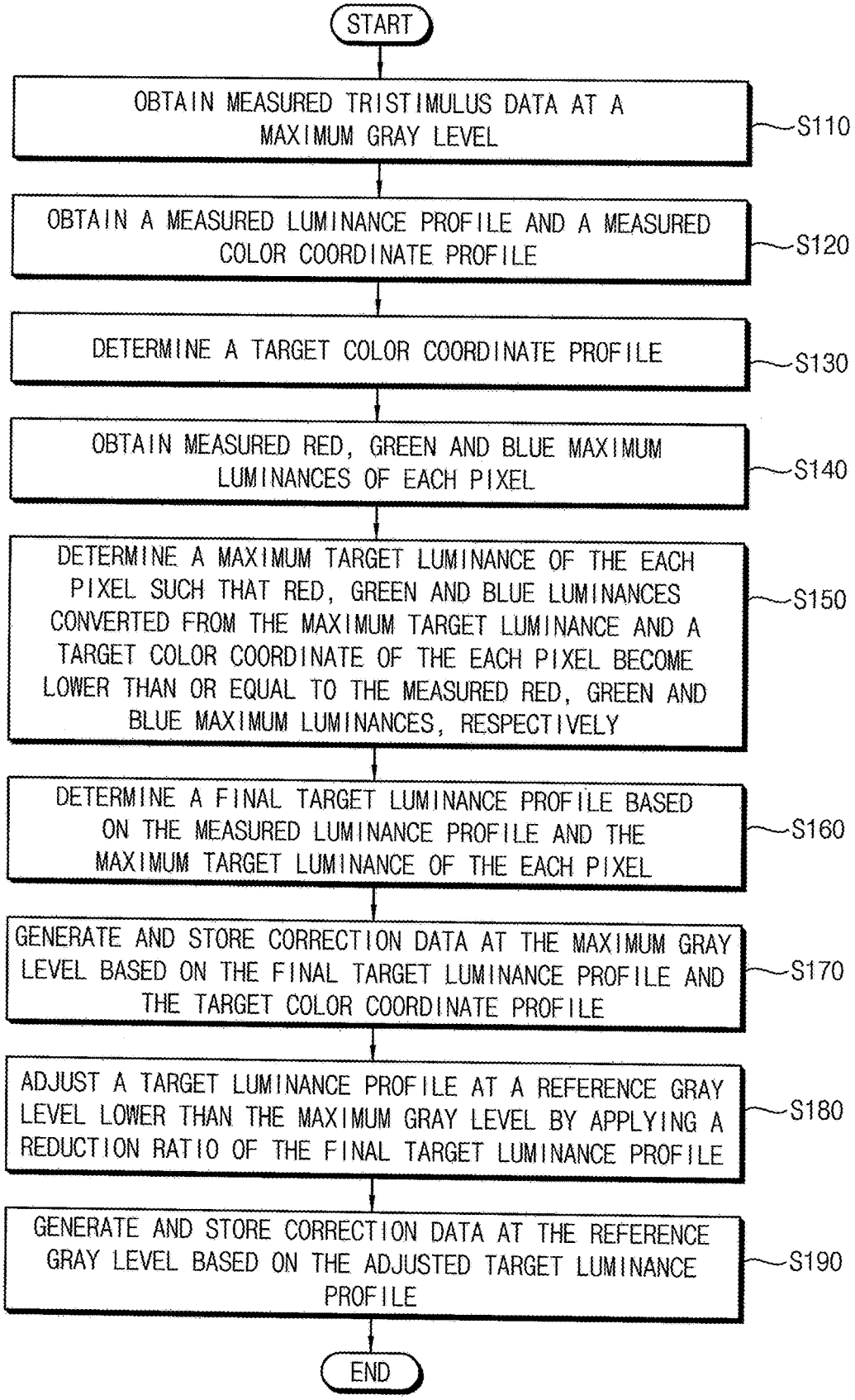
FIG. 1 is a flowchart illustrating an exemplary embodiment of a method of generating correction data for a display device.

Hereinafter, embodiments of the invention will be explained in detail with reference to the accompanying drawings.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of at least one of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of at least one other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within at least one standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Figure 2:
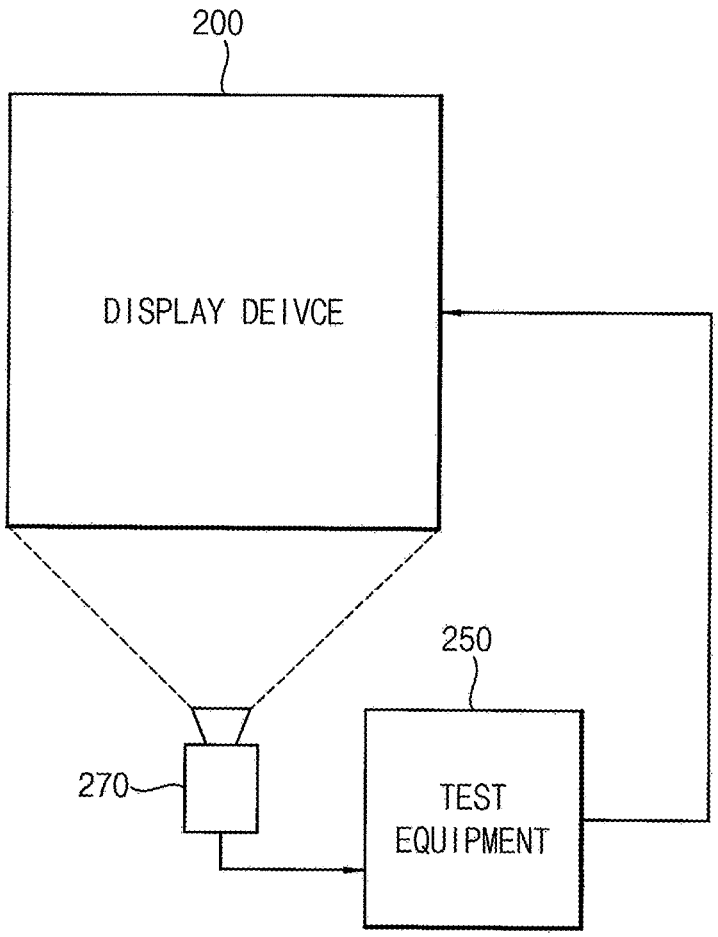
FIG. 2 is a block diagram illustrating an example of a test equipment performing a method of FIG. 1.
Figure 3A:
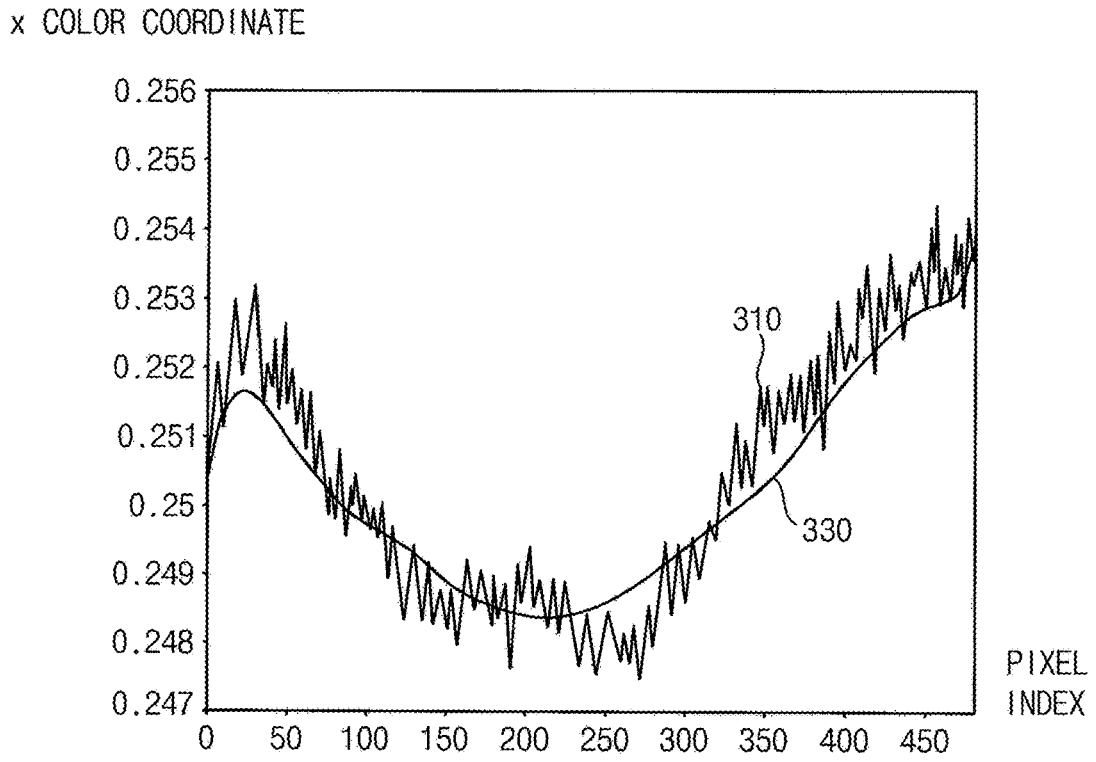
FIG. 3A is a graph illustrating an example of a measured x-color coordinate profile and a target x-color coordinate profile at a maximum gray level.
Figure 3B:
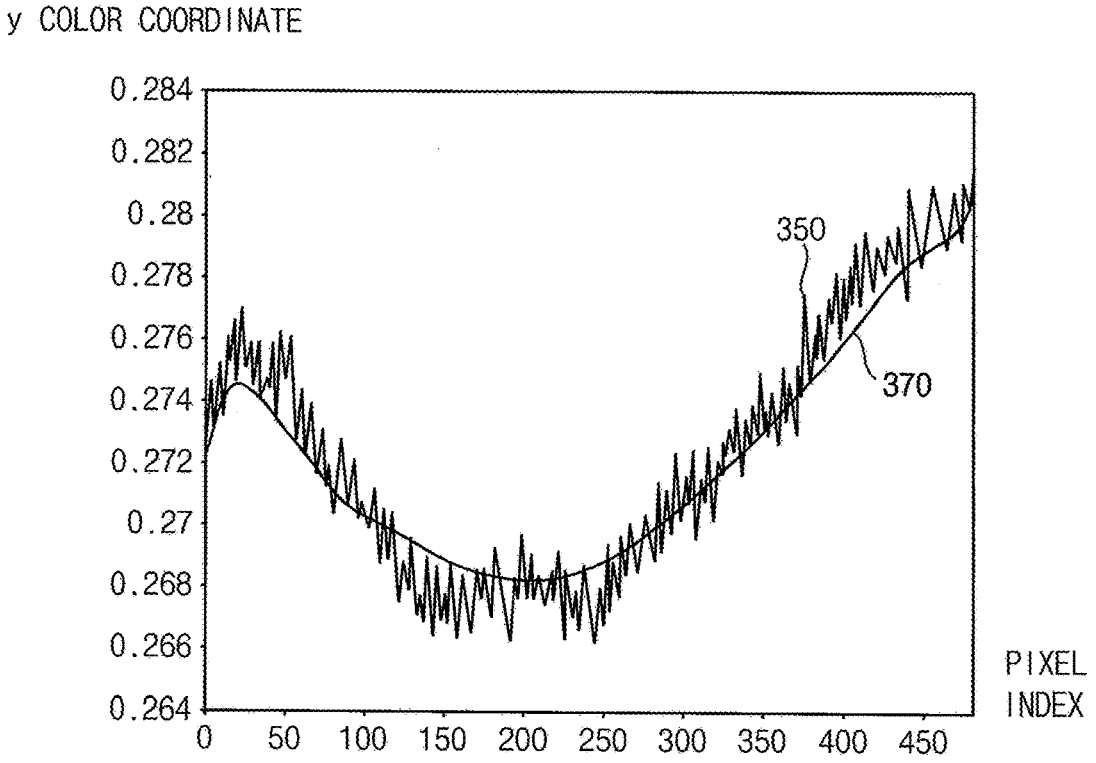
FIG. 3B is a graph illustrating an example of a measured y-color coordinate profile and a target y-color coordinate profile at a maximum gray level.
Figure 4:
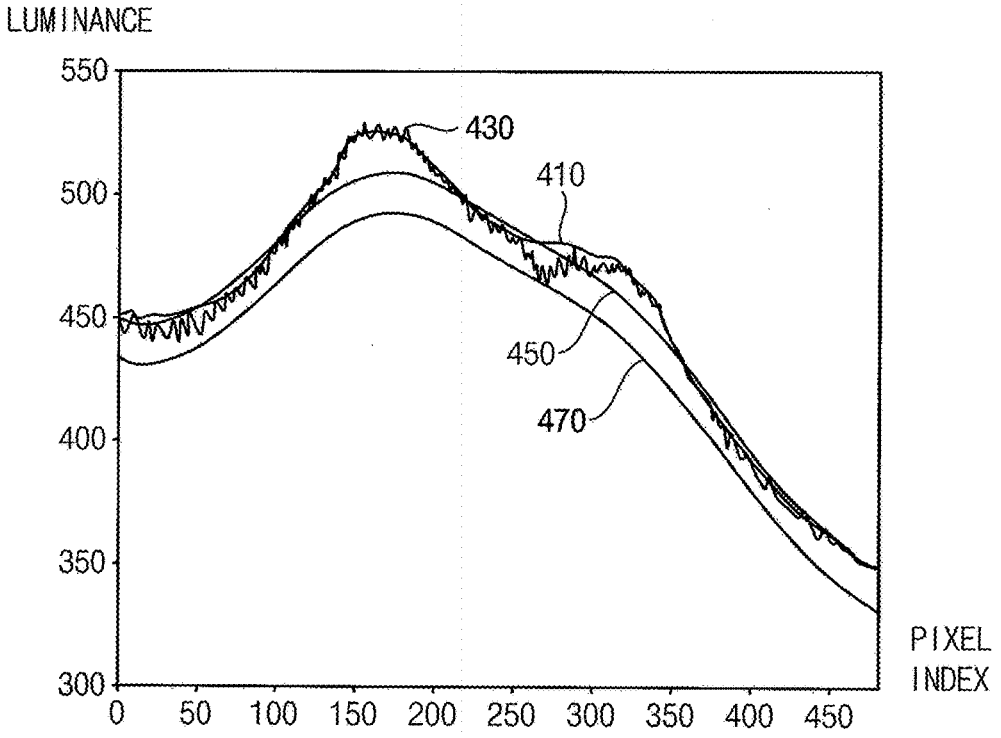
FIG. 4 is a graph illustrating an example of a measured luminance profile, a maximum target luminance profile, an intermediate target luminance profile and a final target luminance profile at a maximum gray level.
Figure 5A:
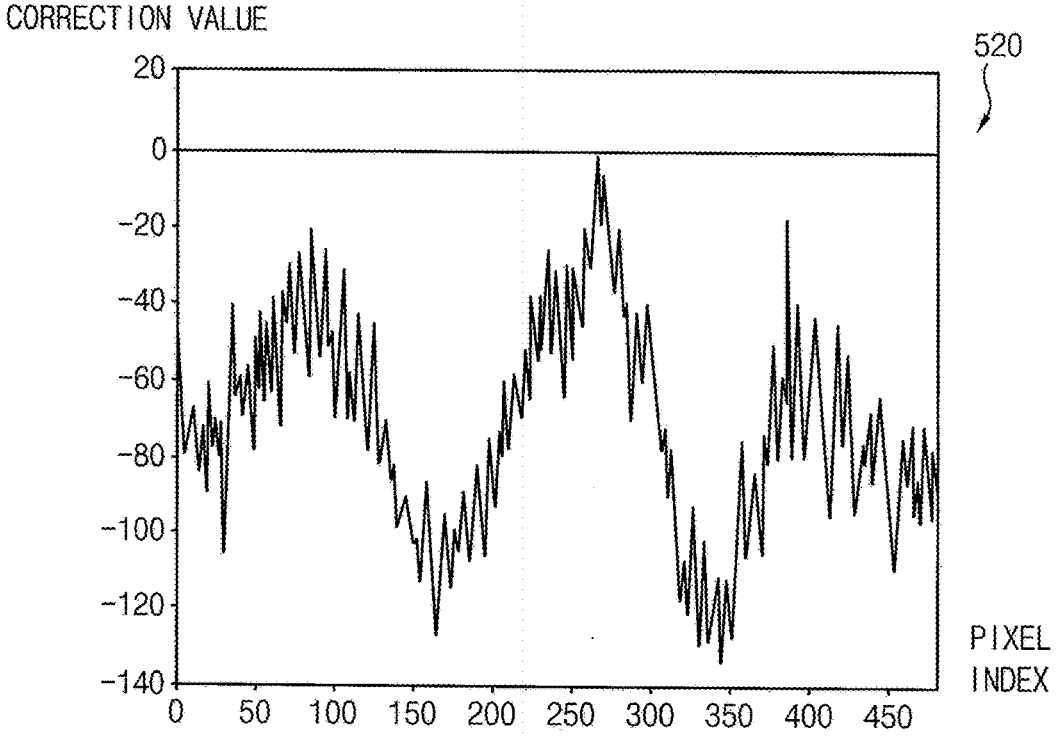
FIG. 5A is a graph illustrating an example of correction data for red sub-pixels a maximum gray level.
Figure 5B:
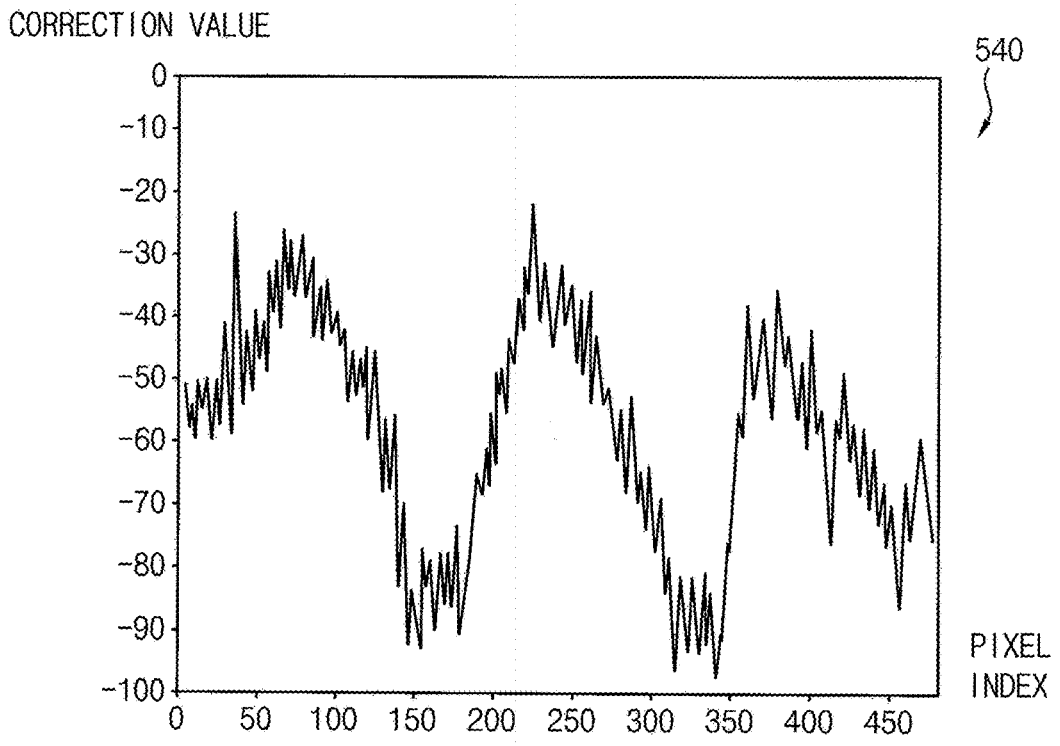
FIG. 5B is a graph illustrating an example of correction data for green sub-pixels a maximum gray level.
Figure 5C:
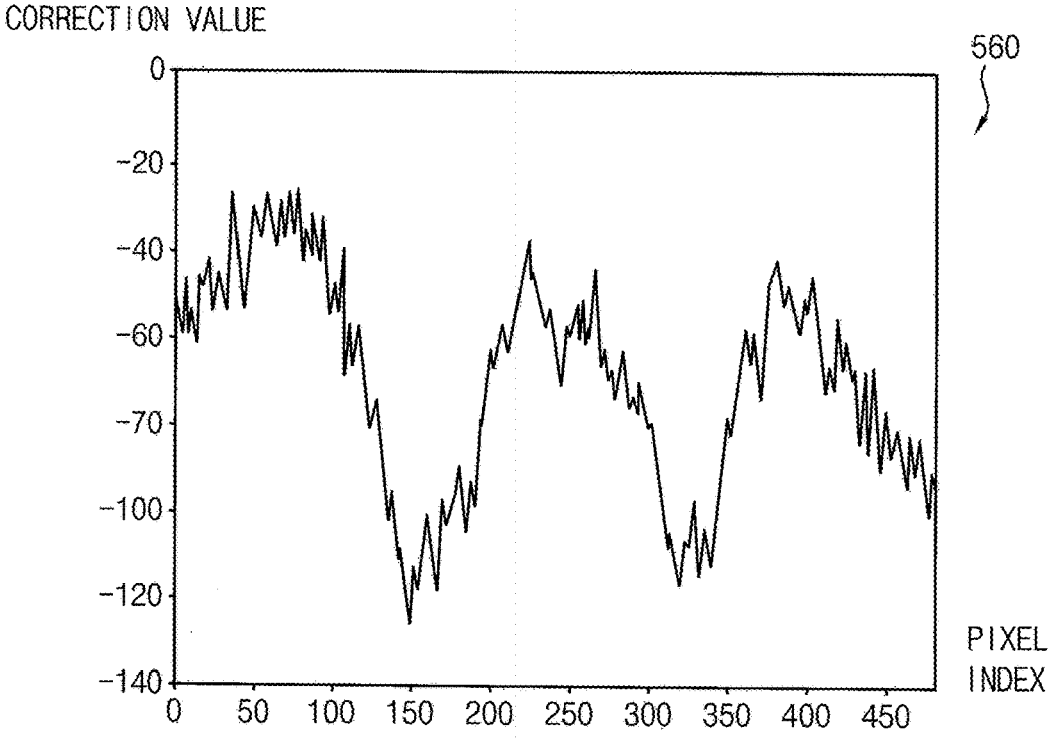
FIG. 5C is a graph illustrating an example of correction data for blue sub-pixels a maximum gray level.
Figure 6:
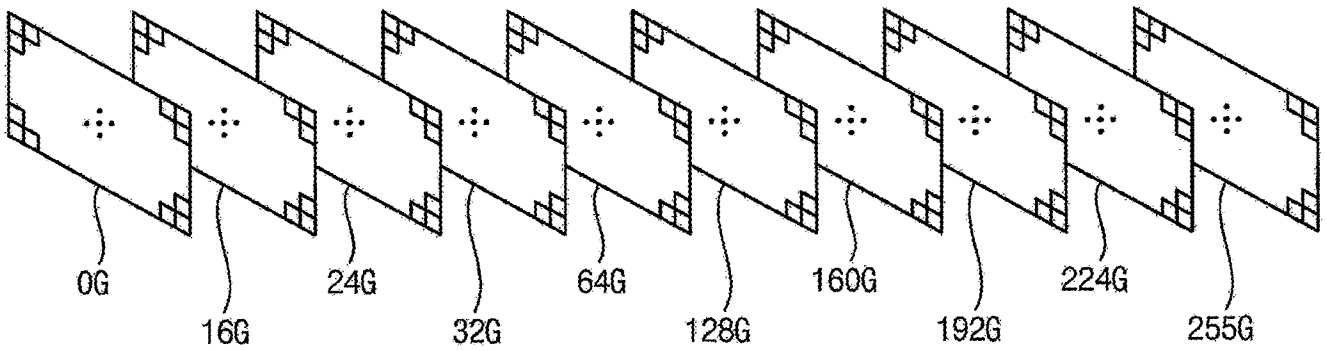
FIG. 6 is a diagram for describing an example of a plurality of reference gray levels at which correction data are generated and stored.

FIG. 1 is a flowchart illustrating a method of generating correction data for a display device according to exemplary embodiments, FIG. 2 is a block diagram illustrating an example of a test equipment performing a method of FIG. 1, FIG. 3A is a graph illustrating an example of a measured x-color coordinate profile and a target x-color coordinate profile at a maximum gray level, FIG. 3B is a graph illustrating an example of a measured y-color coordinate profile and a target y-color coordinate profile at a maximum gray level, FIG. 4 is a graph illustrating an example of a measured luminance profile, a maximum target luminance profile, an intermediate target luminance profile and a final target luminance profile at a maximum gray level, FIG. 5A is a graph illustrating an example of correction data for red sub-pixels a maximum gray level, FIG. 5B is a graph illustrating an example of correction data for green sub-pixels a maximum gray level, FIG. 5C is a graph illustrating an example of correction data for blue sub-pixels a maximum gray level, and FIG. 6 is a diagram for describing an example of a plurality of reference gray levels at which correction data are generated and stored.

Referring to FIGS. 1 and 2, a method of generating correction data for a display device 200 according to exemplary embodiments may be performed by a test equipment 250 that performs an automatic test process (e.g., an automatic manual test ("AMT") process). The test equipment 250 may obtain measured tristimulus data (e.g., international commission on illumination ("CIE") 1931 XYZ data) of the display device 200 at a maximum gray level (e.g., a 255-gray level) by capturing a white image displayed at the maximum gray level by the display device 200 by a camera (e.g., a charge coupled device ("CCD") camera) 270 (S110). In some exemplary embodiments, the test equipment 250 may provide the display device 200 with white maximum gray data, for example RGB data including red data representing the maximum gray level, green data representing the maximum gray level and blue data representing the maximum gray level, and may obtain the measured tristimulus data at the maximum gray level by capturing the white image displayed by the display device 200 based on the white maximum gray data.

A measured luminance profile and a measured color coordinate profile of the display device 200 at the maximum gray level may be obtained based on the measured tristimulus data at the maximum gray level (S120). In some exemplary embodiments, the measured tristimulus data (e.g., XYZ data) at the maximum gray level may be converted to luminance and color coordinate data (e.g., Lxy data) in a luminance and color coordinate domain (e.g., an Lxy domain). In an exemplary embodiment, the XYZ data may be converted to the Lxy data by equations "L=Y", "x=X/(X+Y+Z)" and "y=Y/(X+Y+Z)", for example. The measured luminance profile may be obtained based on luminance data (e.g., L data) among the luminance and color coordinate data, and the measured color coordinate profile may be obtained based on color coordinate data (e.g., xy data) among the luminance and color coordinate data. Further, the measured color coordinate profile may include a measured x-color coordinate profile and a measured y-color coordinate profile. The measured x-color coordinate profile may be obtained based on x-color coordinate data (e.g., x data) among the luminance and color coordinate data, and the measured y-color coordinate profile may be obtained based on y-color coordinate data (e.g., y data) among the luminance and color coordinate data.

A target color coordinate profile of the display device 200 at the maximum gray level may be determined based on the measured color coordinate profile (S130). In some exemplary embodiments, the target color coordinate profile may include a target x-color coordinate profile and a target y-color coordinate profile. As illustrated in FIG. 3A, the target x-color coordinate profile 330 may be determined by calculating a moving average for the measured x-color coordinate profile 310. As illustrated in FIG. 3B, the target y-color coordinate profile 370 may be determined by calculating a moving average for the measured y-color coordinate profile 350. As illustrated in FIGS. 3A and 3B, the target x-color coordinate profile 330 and the target y-color coordinate profile 370 may be determined as smooth lines (or surfaces), and thus a color mura defect of the display device 200 may be removed or corrected by correction data generated based on the target color coordinate profile. Although FIGS. 3A and 3B illustrate x-color coordinate profiles 310 and 330 and y-color coordinate profiles 350 and 370 having line shapes corresponding to one horizontal pixel line for illustration purposes, the x-color coordinate profiles 310 and 330 and y-color coordinate profiles 350 and 370 according to exemplary embodiments may have surface shapes corresponding to the entire display panel.

A measured red maximum luminance, a measured green maximum luminance and a measured blue maximum luminance of each pixel in the display device 200 may be obtained (S140). Here, the measured red maximum luminance of a pixel may represent a measured luminance of the pixel when data signals at a minimum gray level (e.g., a 0-gray level) are applied to green and blue sub-pixels of the pixel and a data signal at the maximum gray level (e.g., the 255-gray level) is applied to a red sub-pixel of the pixel. The measured green maximum luminance of a pixel may represent a measured luminance of the pixel when data signals at the minimum gray level are applied to the red and blue sub-pixels of the pixel and a data signal at the maximum gray level is applied to the green sub-pixel of the pixel. The measured blue maximum luminance of a pixel may represent a measured luminance of the pixel when data signals at the minimum gray level are applied to the red and green sub-pixels of the pixel and a data signal at the maximum gray level is applied to the blue sub-pixel of the pixel.

In some exemplary embodiments, the test equipment 250 may provide the display device 200 with red maximum gray data (e.g., RGB data including red data representing the maximum gray level and green and blue data representing the minimum gray level), may obtain the measured tristimulus data at a red maximum gray level (e.g., the 255-gray level for the red sub-pixel, and the 0-gray level for the green and blue sub-pixels) by capturing a red image displayed by the display device 200 based on the red maximum gray data, and may obtain the measured red maximum luminance of the each pixel from the measured tristimulus data at the red maximum gray level. In an exemplary embodiment, Y data for the each pixel among the measured tristimulus data (e.g., XYZ data) at the red maximum gray level may be obtained as the measured red maximum luminance, for example. Further, the test equipment 250 may provide the display device 200 with green maximum gray data (e.g., RGB data including green data representing the maximum gray level and red and blue data representing the minimum gray level), may obtain the measured tristimulus data at a green maximum gray level (e.g., the 255-gray level for the green sub-pixel, and the 0-gray level for the red and blue sub-pixels) by capturing a green image displayed by the display device 200 based on the green maximum gray data, and may obtain the measured green maximum luminance of the each pixel from the measured tristimulus data at the green maximum gray level. In an exemplary embodiment, Y data for the each pixel among the measured tristimulus data (e.g., XYZ data) at the green maximum gray level may be obtained as the measured green maximum luminance, for example. Further, the test equipment 250 may provide the display device 200 with blue maximum gray data (e.g., RGB data including blue data representing the maximum gray level and red and green data representing the minimum gray level), may obtain the measured tristimulus data at a blue maximum gray level (e.g., the 255-gray level for the blue sub-pixel, and the 0-gray level for the red and green sub-pixels) by capturing a blue image displayed by the display device 200 based on the blue maximum gray data, and may obtain the measured blue maximum luminance of the each pixel from the measured tristimulus data at the blue maximum gray level. In an exemplary embodiment, Y data for the each pixel among the measured tristimulus data (e.g., XYZ data) at the blue maximum gray level may be obtained as the measured blue maximum luminance, for example.

A maximum target luminance of the each pixel may be determined such that a red luminance, a green luminance and a blue luminance of the each pixel converted from the maximum target luminance and a target color coordinate of the each pixel at the maximum gray level become lower than or equal to the measured red maximum luminance, the measured green maximum luminance and the measured blue maximum luminance of the each pixel, respectively (S150).

In some exemplary embodiments, target luminance and color coordinate data of the each pixel may be obtained by setting the maximum target luminance of the each pixel to a variable α and by obtaining the target color coordinate of the each pixel from the target color coordinate profile. In an exemplary embodiment, the target luminance and color coordinate data of the each pixel may be $$\begin{bmatrix} \alpha \\ Wx'_{255} \\ Wy'_{255} \end{bmatrix},$$

where Wx'255 represents an x-color coordinate value of the target color coordinate of the each pixel, and Wy'255 represents a y-color coordinate value of the target color coordinate of the each pixel, for example. The target luminance and color coordinate data of the each pixel may be converted to target tristimulus data of the each pixel. In an exemplary embodiment, the target luminance and color coordinate data of the each pixel, or $$\begin{bmatrix} \alpha \\ Wx'_{255} \\ Wy'_{255} \end{bmatrix}$$

may be converted to the target tristimulus data of the each pixel, or $$\begin{bmatrix} \frac{W_{x'255}}{W_{y'255}} \cdot \alpha \\ \alpha \\ \frac{W_{z'255}}{W_{y'255}} \cdot \alpha \end{bmatrix},$$

for example. The target tristimulus data of the each pixel may be converted to the red luminance, the green luminance and the blue luminance of the each pixel by an XYZ-to-YrYgYb conversion matrix. In some exemplary embodiments, the XYZ-to-YrYgYb conversion matrix may be:

$$\begin{bmatrix} \frac{W_{xR}}{W_{yR}} & \frac{W_{xG}}{W_{yG}} & \frac{W_{xB}}{W_{yB}} \\ 1 & 1 & 1 \\ \frac{W_{zR}}{W_{yR}} & \frac{W_{zG}}{W_{yG}} & \frac{W_{zB}}{W_{yB}} \end{bmatrix}^{-1},$$

where $W_{xR}$ represents an x-color coordinate value of a red image of the each pixel, $W_{yR}$ represents a y-color coordinate value of the red image of the each pixel, $W_{zR}$ is calculated by subtracting the x-color coordinate value and the y-color coordinate value of the red image of the each pixel from 1, $W_{xG}$ represents an x-color coordinate value of a green image of the each pixel, $W_{yG}$ represents a y-color coordinate value of the green image of the each pixel, $W_{zG}$ is calculated by subtracting the x-color coordinate value and the y-color coordinate value of the green image of the each pixel from 1, $W_{xB}$ represents an x-color coordinate value of a blue image of the each pixel, $W_{yB}$ represents a y-color coordinate value of the blue image of the each pixel, and $W_{zB}$ is calculated by subtracting the x-color coordinate value and the y-color coordinate value of the blue image of the each pixel from 1. The variable a that allows the red luminance, the green luminance and the blue luminance of the each pixel to become lower than or equal to the measured red maximum luminance, the measured green maximum luminance and the measured blue maximum luminance of the each pixel, respectively, may be determined as the maximum target luminance of the each pixel.

In other words, the maximum target luminance of the each pixel may be determined using an equation:

$$\begin{bmatrix} \frac{W_{xR}}{W_{yR}} & \frac{W_{xG}}{W_{yG}} & \frac{W_{xB}}{W_{yB}} \\ 1 & 1 & 1 \\ \frac{W_{zR}}{W_{yR}} & \frac{W_{zG}}{W_{yG}} & \frac{W_{zB}}{W_{yB}} \end{bmatrix}^{-1} \begin{bmatrix} \frac{W_{x'255}}{W_{y'255}} \cdot \alpha \\ \alpha \\ \frac{W_{z'255}}{W_{y'255}} \cdot \alpha \end{bmatrix} \leq \begin{bmatrix} Y_{R255} \\ Y_{G255} \\ Y_{B255} \end{bmatrix},$$

where $\alpha$ represents the maximum target luminance of the each pixel, $W_{x'255}$ represents an x-color coordinate value of the target color coordinate of the each pixel, $W_{y'255}$ represents a y-color coordinate value of the target color coordinate of the each pixel, $W_{z'255}$ is calculated by subtracting the x-color coordinate value and the y-color coordinate value of the target color coordinate of the each pixel from 1, $Y_{R255}$ represents the measured red maximum luminance, $Y_{G255}$ represents the measured green maximum luminance, $Y_{B255}$ represents the measured blue maximum luminance, $W_{xR}$ represents an x-color coordinate value of a red image of the each pixel, $W_{yR}$ represents a y-color coordinate value of the red image of the each pixel, $W_{zR}$ is calculated by subtracting the x-color coordinate value and the y-color coordinate value of the red image of the each pixel from 1, $W_{xG}$ represents an x-color coordinate value of a green image of the each pixel, $W_{yG}$ represents a y-color coordinate value of the green image of the each pixel, $W_{zG}$ is calculated by subtracting the x-color coordinate value and the y-color coordinate value of the green image of the each pixel from 1, $W_{xB}$ represents an x-color coordinate value of a blue image of the each pixel, $W_{yB}$ represents a y-color coordinate value of the blue image of the each pixel, and $W_{zB}$ is calculated by subtracting the x-color coordinate value and the y-color coordinate value of the blue image of the each pixel from 1.

A final target luminance profile of the display device 200 at the maximum gray level may be determined based on the measured luminance profile and the maximum target luminance of the each pixel (S160). In some exemplary embodiments, as illustrated in FIG. 4, the measured luminance profile 410 at the maximum gray level may be obtained based on the measured tristimulus data at the maximum gray level, a maximum target luminance profile 430 representing the maximum target luminances of respective pixels may be obtained by calculating the maximum target luminances for the respective pixels, an intermediate target luminance profile 450 may be determined by calculating a moving average for the measured luminance profile 410 at the maximum gray level, and the final target luminance profile 470 at the maximum gray level may be determined by adjusting the intermediate target luminance profile 450 to become lower than or equal to the maximum target luminance of the each pixel (or to become lower than or equal to the maximum target luminance profile 430 at any position or at any pixel). In some exemplary embodiments, the final target luminance profile 470 may be set as close as possible to the maximum target luminance profile 430, and thus a luminance loss of the display device 200 may be minimized. In an example, the final target luminance profile 470 may be determined by shifting the intermediate target luminance profile 450 by the maximum difference between the maximum target luminance profile 430 and the intermediate target luminance profile 450. A smooth curve corresponding to a difference between the maximum target luminance profile 430 and the intermediate target luminance profile 450 may be obtained by performing spatial filtering at positions where the maximum target luminance profile 430 is higher than the intermediate target luminance profile 450, and the final target luminance profile 470 lower than, but close to, the maximum target luminance profile 430 may be obtained by subtracting the obtained smooth curve from the intermediate target luminance profile 450. As illustrated in FIG. 4, the final target luminance profile 470 at the maximum gray level may be determined as a smooth line (or surface) close to the maximum target luminance profile 430. Accordingly, based on the correction data generated based on the final target luminance profile 470 at the maximum gray level, a luminance mura defect of the display device 200 at the maximum gray level may be removed or corrected while the luminance loss of the display device 200 may be minimized. Although FIG. 4 illustrates luminance profiles 410, 430, 450 and 470 having line shapes corresponding to one horizontal pixel line for illustration purposes, the luminance profiles 410, 430, 450 and 470 in exemplary embodiments may have surface shapes corresponding to the entire display panel.

The correction data at the maximum gray level may be generated based on the final target luminance profile and the target color coordinate profile at the maximum gray level, and the correction data at the maximum gray level may be stored in the display device 200 (S170).

In some exemplary embodiments, a target red luminance, a target blue luminance and a target green luminance of the each pixel may be calculated based on the final target luminance profile and the target color coordinate profile at the maximum gray level, a target red gray level, a target green gray level and a target blue gray level respectively corresponding to the target red luminance, the target blue luminance and the target green luminance of the each pixel may be obtained, and a value generated by subtracting a maximum red gray level from the target red gray level, a value generated by subtracting a maximum green gray level from the target green gray level and a value generated by subtracting a maximum blue gray level from the target blue gray level may be stored as the correction data at the maximum gray level in the display device 200. In an exemplary embodiment, a target luminance of a pixel may be obtained from the final target luminance profile, a target color coordinate of the pixel may be obtained from the target color coordinate profile, a target tristimulus value of the pixel may be obtained by converting the target luminance and the target color coordinate of the pixel to the target tristimulus value in a tristimulus domain (or an XYZ domain), and the target red luminance, the target blue luminance and the target green luminance of the pixel may be calculated by an equation, for example:

$$\begin{bmatrix} \frac{Wx_R}{Wy_R} & \frac{Wx_G}{Wy_G} & \frac{Wx_B}{Wy_B} \\ 1 & 1 & 1 \\ \frac{Wz_R}{Wz_R} & \frac{Wz_G}{Wy_G} & \frac{Wz_B}{Wy_B} \end{bmatrix}^{-1} \begin{bmatrix} X_{Gray_target} \\ Y_{Gray_target} \\ Z_{Gray_target} \end{bmatrix} = \begin{bmatrix} Y_{R_target} \\ Y_{G_target} \\ Y_{B_target} \end{bmatrix}, \text{ where } \begin{bmatrix} X_{Gray_target} \\ Y_{Gray_target} \\ Z_{Gray_target} \end{bmatrix}$$

may be the target tristimulus value of the pixel, and $$\begin{bmatrix} Y_{R_target} \\ Y_{G_target} \\ Y_{B_target} \end{bmatrix}$$

may be the target red luminance, the target blue luminance and the target green luminance of the pixel. Further, the target red gray level of the pixel may be obtained from the target red luminance of the pixel and a gray-luminance profile for a red sub-pixel of the pixel, the target green gray level of the pixel may be obtained from the target green luminance of the pixel and a gray-luminance profile for a green sub-pixel of the pixel, and the target blue gray level of the pixel may be obtained from the target blue luminance of the pixel and a gray-luminance profile for a blue sub-pixel of the pixel. The gray-luminance profiles for the red, green and blue sub-pixels may be obtained by luminances measured at predetermined reference gray levels.

The correction data for the pixel at the maximum gray level may include a correction value for the red sub-pixel of the pixel, a correction value for the green sub-pixel of the pixel and a correction value for the blue sub-pixel of the pixel, the correction value for the red sub-pixel may be a value generated by subtracting the maximum red gray level (e.g., the 255-gray level) from the target red gray level, the correction value for the green sub-pixel may be a value generated by subtracting the maximum green gray level (e.g., the 255-gray level) from the target green gray level, and the correction value for the blue sub-pixel may be a value generated by subtracting the maximum blue gray level (e.g., the 255-gray level) from the target blue gray level. Accordingly, as illustrated in FIGS. 5A through 5C, the correction data at the maximum gray level may have the correction values lower than or equal to 0. In FIGS. 5A through 5C, a reference numeral 520 may represent an example of correction values for red sub-pixels included in respective pixels, a reference numeral 540 may represent an example of correction values for green sub-pixels included in the respective pixels, and a reference numeral 560 may represent an example of correction values for blue sub-pixels included in the respective pixels. Since the correction data 520, 540 and 560 at the maximum gray level have only the negative correction values or the correction values of 0, the display device 200 may remove or correct the luminance mura defect and/or the color mura defect even at the maximum gray level.

The correction data may be generated and stored not only at the maximum gray level but also at at least one gray level lower than the maximum gray level. In some exemplary embodiments, the correction data may be obtained at the entire gray levels (e.g., 256 gray levels from the 0-gray level to the 255-gray level. However, in this case, a size of the correction data may be excessively increased. In other exemplary embodiments, to prevent the excessive increase in size of the correction data, the correction data may be obtained at at least one reference gray level corresponding to a portion of the entire gray levels. In an exemplary embodiment, as illustrated in FIG. 6, the correction data may be obtained at ten reference gray levels, or 0-gray level 0G, 16-gray level 16G, 24-gray level 24G, 32-gray level 32G, 64-gray level 64G, 128-gray level 128G, 160-gray level 160G, 192-gray level 192G, 224-gray level 224G and 255-gray level 255G, for example. However, the at least one reference gray level in exemplary embodiments may not be limited to the ten reference gray levels as illustrated in FIG. 6.

In some exemplary embodiments, the final target luminance profile at the at least one reference gray level lower than the maximum gray level may be obtained by applying a reduction ratio of an average of the final target luminance profile at the maximum gray level to an average of the measured luminance profile at the maximum gray level (or an average of the intermediate target luminance profile at the maximum gray level) to an intermediate target luminance profile at the at least one reference gray level (S180), the correction data at the at least one reference gray level may be generated based on the final target luminance profile at at least one reference gray level, and the correction data at the at least one reference gray level may be stored in the display device 200 (S190).

Figure 7:
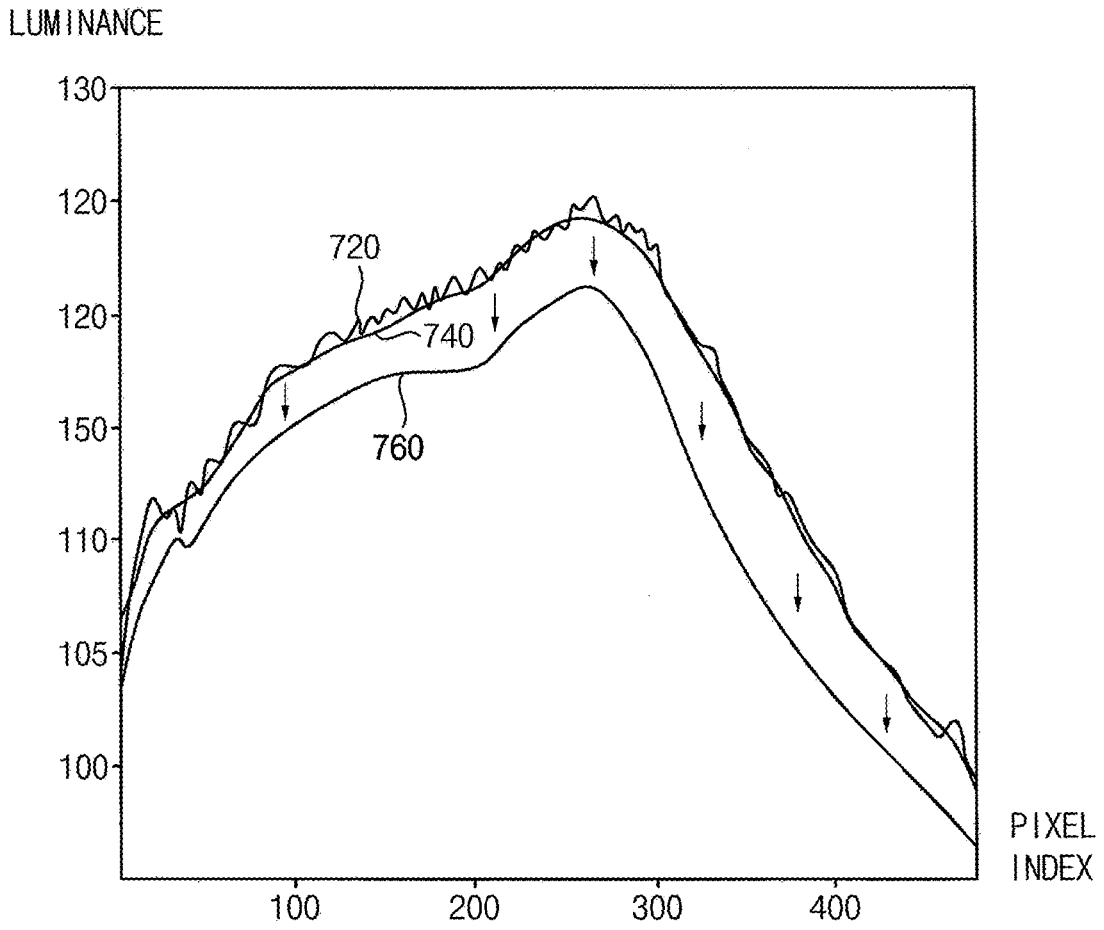
FIG. 7 is a graph illustrating an example of a measured luminance profile, an intermediate target luminance profile and a final target luminance profile at gray level lower than a maximum gray level.

In an exemplary embodiment, the measured tristimulus data at the at least one reference gray level may be obtained by capturing an image at the at least one reference gray level lower than the maximum gray level displayed by the display device 200, the measured luminance profile and the measured color coordinate profile at the at least one reference gray level may be obtained based on the measured tristimulus data at the at least one reference gray level, the intermediate target luminance profile at the at least one reference gray level may be determined by calculating a moving average for the measured luminance profile at the at least one reference gray level, and the target color coordinate profile at the at least one reference gray level may be determined by calculating a moving average for the measured color coordinate profile at the at least one reference gray level, for example. In an exemplary embodiment, as illustrated in FIG. 7, the intermediate target luminance profile 740 at the reference gray level may be obtained by calculating the moving average for the measured luminance profile 720 at the reference gray level, for example. Further, the final target luminance profile 760 at the reference gray level may be obtained by multiplying the intermediate target luminance profile 740 by the reduction ratio of the average of the final target luminance profile at the maximum gray level to the average of the measured luminance profile at the maximum gray level (or the average of the intermediate target luminance profile at the maximum gray level). The correction data at the reference gray level may be determined based on the final target luminance profile 760 and the target color coordinate profile at the reference gray level. As described above, since the reduction ratio at the maximum gray level is also applied to the reference gray level lower than the maximum gray level, a gamma characteristic of the display device 200 may not be changed.

As described above, in the method of generating the correction data for the display device 200 in exemplary embodiments, the maximum target luminance of each pixel may be determined such that the red luminance, the green luminance and the blue luminance of the each pixel converted from the maximum target luminance and the target color coordinate of the each pixel at the maximum gray level (e.g., the 255-gray level) may become lower than or equal to the measured red maximum luminance, the measured green maximum luminance and the measured blue maximum luminance, respectively, and the final target luminance profile at the maximum gray level may be determined based on the measured luminance profile and the maximum target luminance of the each pixel. Accordingly, the correction data may be generated even at the maximum gray level, and the display device 200 may perform luminance mura correction and/or color mura correction even at the maximum gray level based on the correction data.

Figure 8:
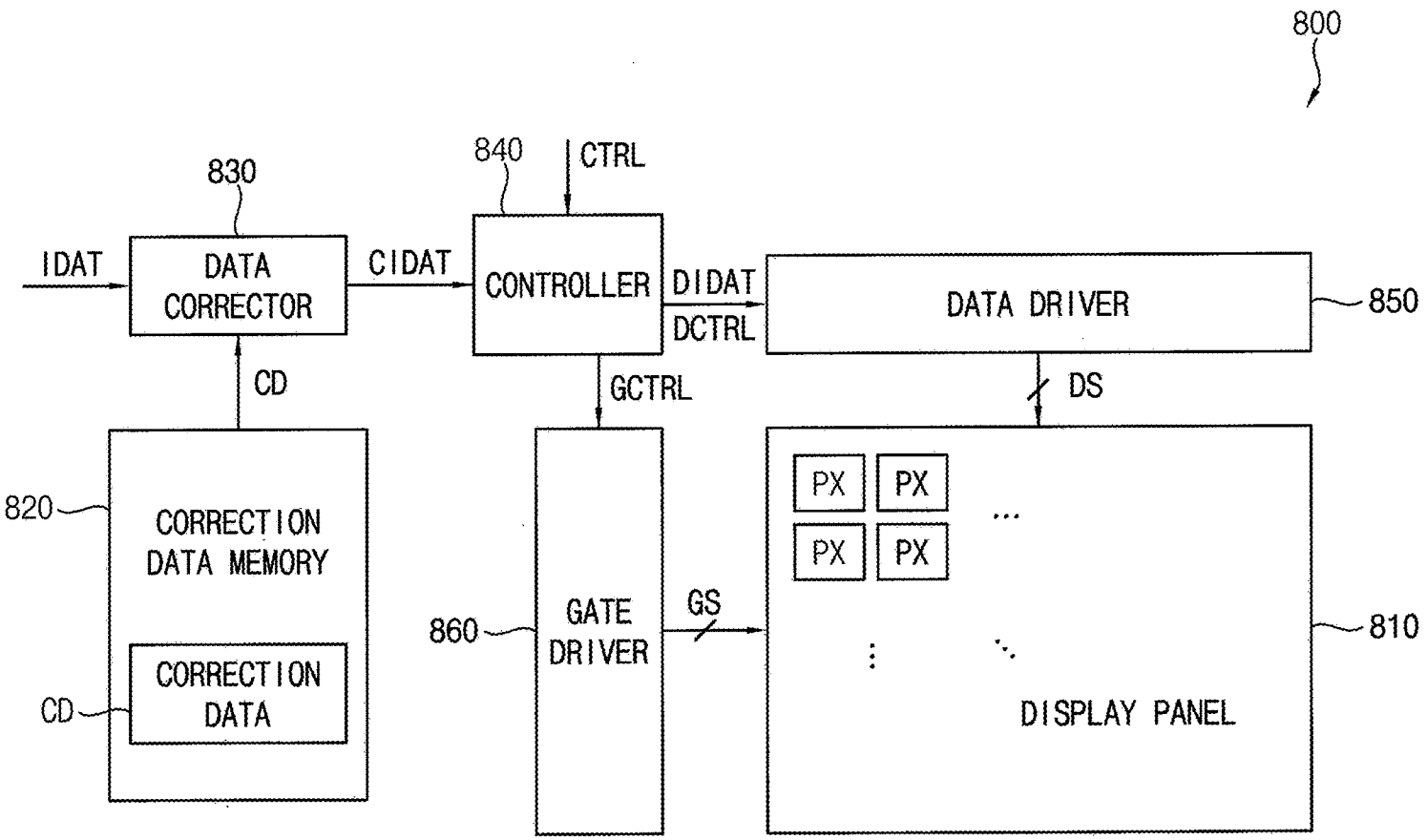
FIG. 8 is a block diagram illustrating an exemplary embodiment of a display device.
Figure 9:
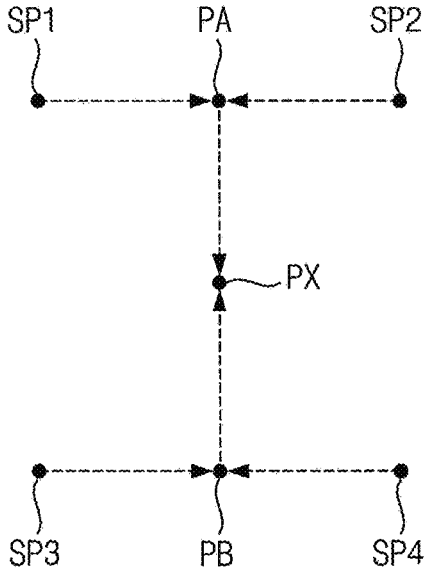
FIG. 9 is a diagram for describing an example of a bilinear interpolation performed by a data corrector included in a display device of FIG. 8.

FIG. 8 is a block diagram illustrating an exemplary embodiment of a display device, and FIG. 9 is a diagram for describing an example of a bilinear interpolation performed by a data corrector included in a display device of FIG. 8.

Referring to FIG. 8, a display device 800 in exemplary embodiments may include a display panel 810 that includes a plurality of pixels PX, a correction data memory 820 that stores correction data CD, a data corrector 830 that corrects image data IDAT based on the correction data CD, a data driver 850 that provides data signals DS to the plurality of pixels PX, a gate driver 860 that provides gate signals GS to the plurality of pixels PX, and a controller 840 that controls an operation of the display device 800.

The display panel 810 may include a plurality of data lines, a plurality of gate lines, and the plurality of pixels PX coupled to the plurality of data lines and the plurality of gate lines. In some exemplary embodiments, each pixel PX may include a switching transistor and a liquid crystal capacitor coupled to the switching transistor, and the display panel 810 may be a liquid crystal display ("LCD") panel. In other exemplary embodiments, each pixel PX may include an organic light emitting diode ("OLED"), at least one capacitor and at least two transistors, and the display panel 810 may be an OLED display panel. However, the display panel 810 may not be limited to the LCD panel and the OLED display panel, and may be any suitable display panel.

The correction data memory 820 may store the correction data CD at a plurality reference gray levels (e.g., 10 gray levels in FIG. 6) including a maximum gray level (e.g., a 255-gray level). In some exemplary embodiments, measured tristimulus data at the maximum gray level may be obtained by capturing a white image at the maximum gray level displayed by the display device 800, a measured luminance profile and a measured color coordinate profile at the maximum gray level may be obtained based on the measured tristimulus data at the maximum gray level, a target color coordinate profile at the maximum gray level may be determined based on the measured color coordinate profile, a measured red maximum luminance, a measured green maximum luminance and a measured blue maximum luminance of each pixel PX may be obtained, a maximum target luminance of the each pixel PX may be determined such that a red luminance, a green luminance and a blue luminance of the each pixel PX converted from the maximum target luminance and a target color coordinate of the each pixel PX at the maximum gray level become lower than or equal to the measured red maximum luminance, the measured green maximum luminance and the measured blue maximum luminance of the each pixel PX, respectively, a final target luminance profile at the maximum gray level may be determined based on the measured luminance profile and the maximum target luminance of the each pixel PX, and the correction data CD at the maximum gray level may be generated based on the final target luminance profile and the target color coordinate profile at the maximum gray level.

Further, in some exemplary embodiments, target luminance and color coordinate data of the each pixel PX may be obtained by setting the maximum target luminance of the each pixel PX to a variable a and by obtaining the target color coordinate of the each pixel PX from the target color coordinate profile, the target luminance and color coordinate data of the each pixel PX may be converted to target tristimulus data of the each pixel PX, the target tristimulus data of the each pixel PX may be converted to the red luminance, the green luminance and the blue luminance of the each pixel PX by an XYZ-to-YrYgYb conversion matrix, and the variable a may be determined as the maximum target luminance of the each pixel PX such that the red luminance, the green luminance and the blue luminance of the each pixel PX become lower than or equal to the measured red maximum luminance, the measured green maximum luminance and the measured blue maximum luminance of the each pixel PX, respectively. In an exemplary embodiment, the XYZ-to-YrYgYb conversion matrix may be, for example:

$$\begin{bmatrix} \frac{W_{xR}}{W_{yR}} & \frac{W_{xG}}{W_{yG}} & \frac{W_{xB}}{W_{yB}} \\ 1 & 1 & 1 \\ \frac{W_{zR}}{W_{yR}} & \frac{W_{zG}}{W_{yG}} & \frac{W_{zB}}{W_{yB}} \end{bmatrix}^{-1},$$

where α represents the maximum target luminance of the each pixel PX, $W_{x'255}$ represents an x-color coordinate value of the target color coordinate of the each pixel PX, $W_{y'255}$ represents a y-color coordinate value of the target color coordinate of the each pixel PX, $Y_{R255}$ represents the measured red maximum luminance, $Y_{G255}$ represents the measured green maximum luminance, $Y_{B255}$ represents the measured blue maximum luminance, $W_{xR}$ represents an x-color coordinate value of a red image of the each pixel PX, $W_{yR}$ represents a y-color coordinate value of the red image of the each pixel PX, $W_{zR}$ is calculated by subtracting the x-color coordinate value and the y-color coordinate value of the red image of the each pixel PX from 1, $W_{xG}$ represents an x-color coordinate value of a green image of the each pixel PX, $W_{yG}$ represents a y-color coordinate value of the green image of the each pixel PX, $W_{zG}$ is calculated by subtracting the x-color coordinate value and the y-color coordinate value of the green image of the each pixel PX from 1, $W_{xB}$ represents an x-color coordinate value of a blue image of the each pixel PX, $W_{yB}$ represents a y-color coordinate value of the blue image of the each pixel PX, and $W_{zB}$ is calculated by subtracting the x-color coordinate value and the y-color coordinate value of the blue image of the each pixel PX from 1.

In other words, the maximum target luminance of the each pixel PX may be determined using an equation:

$$\begin{bmatrix} \frac{W_{xR}}{W_{yR}} & \frac{W_{xG}}{W_{yG}} & \frac{W_{xB}}{W_{yB}} \\ 1 & 1 & 1 \\ \frac{W_{zR}}{W_{yR}} & \frac{W_{zG}}{W_{yG}} & \frac{W_{zB}}{W_{yB}} \end{bmatrix}^{-1} \begin{bmatrix} \frac{W_{x'255}}{W_{y'255}} \cdot \alpha \\ \alpha \\ \frac{W_{z'255}}{W_{y'255}} \cdot \alpha \end{bmatrix} \leq \begin{bmatrix} Y_{R255} \\ Y_{G255} \\ Y_{B255} \end{bmatrix},$$

where α represents the maximum target luminance of the each pixel PX, $W_{x'255}$ represents an x-color coordinate value of the target color coordinate of the each pixel PX, $W_{y'255}$ represents a y-color coordinate value of the target color coordinate of the each pixel PX, $W_{z'255}$ is calculated by subtracting the x-color coordinate value and the y-color coordinate value of the target color coordinate of the each pixel from 1, $Y_{R255}$ represents the measured red maximum luminance, $Y_{G255}$ represents the measured green maximum luminance, and $Y_{B255}$ represents the measured blue maximum luminance.

The data corrector 830 may correct the image data IDAT based on the correction data CD, and may output the corrected image data CIDAT. In some exemplary embodiments, the correction data CD may include a plurality of correction values only at a plurality of sampling positions corresponding to a portion of the entire pixels PX of the display panel 810. With respect to each pixel PX, the data corrector 830 may correct the image data IDAT for the each pixel PX by performing a bilinear interpolation on the plurality of correction values at four sampling points adjacent to the each pixel PX among the plurality of sampling positions. In an exemplary embodiment, as illustrated in FIG. 9, to correct the image data IDAT for the pixel PX, the data corrector 830 may perform the bilinear interpolation on correction values at first through fourth sampling positions SP1, SP2, SP3 and SP4 adjacent to the pixel PX, for example. That is, the data corrector 830 may calculate a correction value at a first intermediate position PA by performing a linear interpolation on the correction values at the first and second sampling positions SP1 and SP2, may calculate a correction value at a second intermediate position PB by performing a linear interpolation on the correction values at the third and fourth sampling positions SP3 and SP4, and may calculate a correction value for the pixel PX by performing a linear interpolation on the correction values at the first and second intermediate positions PA and PB.

Further, in some exemplary embodiments, the correction data CD may be stored at each of a plurality of reference gray levels, and the data corrector 830 may correct, with respect to each pixel PX, the image data IDAT for the each pixel PX by performing a linear interpolation on the plurality of correction values at two reference gray levels adjacent to a gray level of the image data IDAT for the each pixel PX among the plurality of reference gray levels. In exemplary embodiments, the linear interpolation between gray levels may be performed after the bilinear interpolation is performed, or may be performed before the bilinear interpolation is performed.

The correction data CD stored in the correction data memory 820 may include the correction data CD at the maximum gray level (e.g., the 255-gray level), and the correction data CD at the maximum gray level may have correction values lower than or equal to 0. Thus, even when the image data IDAT representing the maximum gray level are received, the data corrector 830 may correct the data IDAT representing the maximum gray level based on the correction data CD at the maximum gray level which have the correction values lower than or equal to 0. Accordingly, the display device 800 may remove or correct the luminance mura defect and/or the color mura defect even at the maximum gray level.

The controller (e.g., a timing controller "TCON") 840 may receive a control signal CTRL from an external host processor (e.g., a graphic processing unit ("GPU") or a graphic card), and may receive the corrected image data CIDAT from the data corrector 830. In some exemplary embodiments, the control signal CTRL may include, but not be limited to, a vertical synchronization signal, a horizontal synchronization signal, an input data enable signal, a master clock signal, etc. The controller 840 may generate a gate control signal GCTRL and a data control signal DCTRL based on the control signal CTRL. Further, the controller 840 may generate dithered image data DIDAT by performing a dithering operation based on the corrected image data CIDAT. In some exemplary embodiments, the controller 840 may perform a spatial dithering operation. In an exemplary embodiment, when each of the corrected image data CIDAT for respective adjacent four pixels PX has a value of 10.25, the controller 840 may output the dithered image data DIDAT having a value of 10 with respect to three pixels PX of the adjacent four pixels PX, and may output the dithered image data DIDAT having a value of 11 with respect to one pixel PX of the adjacent four pixels PX, for example. In other exemplary embodiments, the controller 840 may perform a temporal dithering operation. In an exemplary embodiment, when the corrected image data CIDAT for one pixel PX has a value of 10.25 in consecutive four frames, the controller 840 may output the dithered image data DIDAT having a value of 10 with respect to the pixel PX in three frames of the consecutive four frames, and may output the dithered image data DIDAT having a value of '11' with respect to the pixel PX in the remaining one frame of the consecutive four frames, for example. In still other exemplary embodiments, the controller 840 may perform both of the spatial dithering operation and the temporal dithering operation.

The data driver 850 may generate the data signals DS based on the dithered image data DIDAT and the data control signal DCTRL output from the controller 840, and may provide the data signals DS corresponding to the dithered image data DIDAT to the plurality of pixels PX. In an exemplary embodiment, the data control signal DCTRL may include, but not be limited to, an output data enable signal, a horizontal start signal and a load signal, for example. In some exemplary embodiments, the data driver 850 may be implemented with at least one data integrated circuit ("IC"). Further, according to some exemplary embodiments, the data driver 850 may be disposed (e.g., mounted) directly on the display panel 810, or may be coupled to the display panel 810 in a form of a tape carrier package ("TCP"). In other exemplary embodiments, the data driver 850 may be integrated in a peripheral portion of the display panel 810.

The gate driver 860 may generate the gate signals GS based on the gate control signal GCTRL from the controller 840, and may provide the gate signals GS to the plurality of pixels PX. In some exemplary embodiments, the gate control signal GCTRL may include, but not be limited to, a frame start signal and a gate clock signal. In some exemplary embodiments, the gate driver 860 may be implemented as an amorphous silicon gate ("ASG") driver integrated in the peripheral portion of the display panel 810. In other exemplary embodiments, the gate driver 860 may be implemented with at least one gate IC. Further, according to some exemplary embodiments, the gate driver 860 may be disposed (e.g., mounted) directly on the display panel 810, or may be coupled to the display panel 810 in the form of the TCP.

As described above, the display device 800 in exemplary embodiments may store the correction data CD at the plurality of reference gray levels including the maximum gray level (e.g., the 255-gray level), and the correction data CD at the maximum gray level may have the correction values less than or equal to 0. Accordingly, the display device 800 in exemplary embodiments may perform the luminance mura correction and/or the color mura correction even at the maximum gray level based on the correction data CD.

Figure 10:
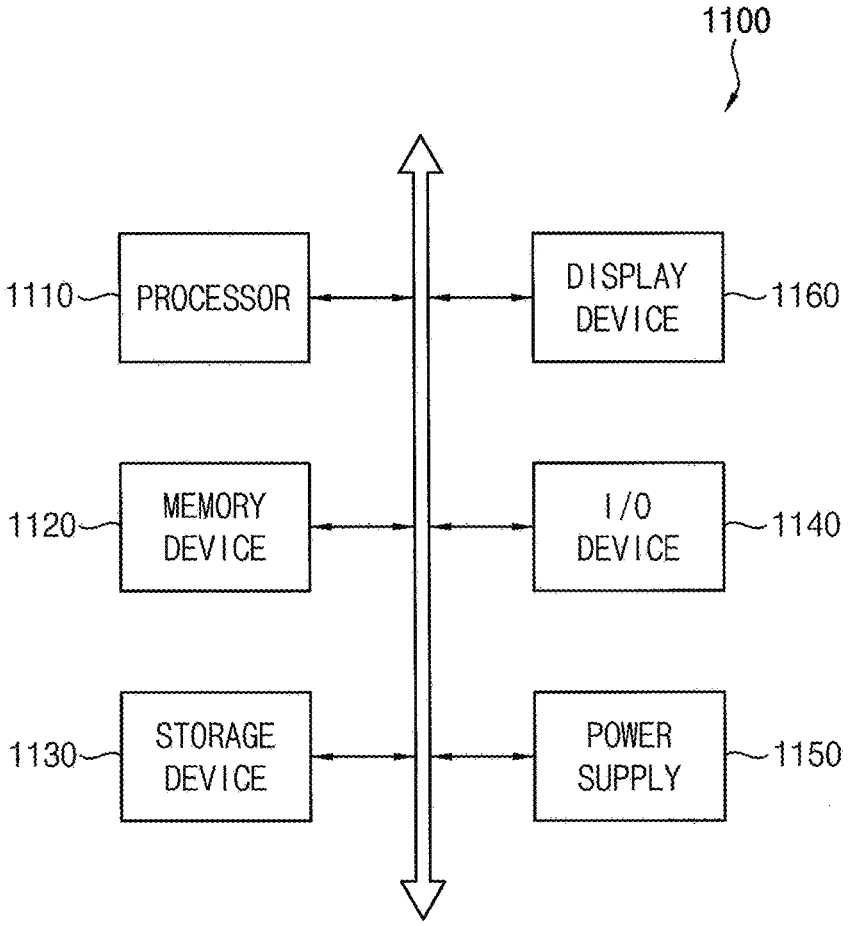
FIG. 10 is a block diagram illustrating an exemplary embodiment of an electronic device including a display device.

FIG. 10 is a block diagram illustrating an electronic device including a display device in exemplary embodiments.

Referring to FIG. 10, an electronic device 1100 may include a processor 1110, a memory device 1120, a storage device 1130, an input/output ("I/O") device 1140, a power supply 1150, and a display device 1160. The electronic device 1100 may further include a plurality of ports for communicating a video card, a sound card, a memory card, a universal serial bus ("USB") device, other electric devices, etc.

The processor 1110 may perform various computing functions or tasks. The processor 1110 may be an application processor ("AP"), a micro processor, a central processing unit ("CPU"), etc. The processor 1110 may be coupled to other components via an address bus, a control bus, a data bus, etc. Further, in some exemplary embodiments, the processor 1110 may be further coupled to an extended bus such as a peripheral component interconnection ("PCI") bus.

The memory device 1120 may store data for operations of the electronic device 1100. In an exemplary embodiment, the memory device 1120 may include at least one non-volatile memory device such as an erasable programmable read-only memory ("EPROM") device, an electrically erasable programmable read-only memory ("EEPROM") device, a flash memory device, a phase change random access memory ("PRAM") device, a resistance random access memory ("RRAM") device, a nano floating gate memory ("NFGM") device, a polymer random access memory ("PoRAM") device, a magnetic random access memory ("MRAM") device, a ferroelectric random access memory ("FRAM") device, etc., and/or at least one volatile memory device such as a dynamic random access memory ("DRAM") device, a static random access memory ("SRAM") device, a mobile dynamic random access memory ("mobile DRAM") device, etc., for example.

The storage device 1130 may be a solid state drive ("SSD") device, a hard disk drive ("HDD") device, a CD-ROM device, etc. The I/O device 1140 may be an input device such as a keyboard, a keypad, a mouse, a touch screen, etc., and an output device such as a printer, a speaker, etc. The power supply 1150 may supply power for operations of the electronic device 1100. The display device 1160 may be coupled to other components through the buses or other communication links.

The display device 1160 may store correction data at a plurality of reference gray levels including a maximum gray level, and the correction data at the maximum gray level may have correction values less than or equal to 0. Accordingly, the display device 1160 may perform luminance mura correction and/or color mura correction even at the maximum gray level based on the correction data.

The inventions may be applied to any display device 1160 performing the mura correction, and any electronic device 1100 including the display device 1160. In an exemplary embodiment, the inventions may be applied to a television ("TV"), a digital TV, a three dimensional ("3D") TV, a smart phone, a wearable electronic device, a tablet computer, a mobile phone, a personal computer ("PC"), a home appliance, a laptop computer, a personal digital assistant ("PDA"), a portable multimedia player ("PMP"), a digital camera, a music player, a portable game console, a navigation device, etc., for example.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

What is claimed is:

1. A method of generating correction data for a display device, the method comprising:

obtaining measured tristimulus data of the display device at a maximum gray level;

obtaining a measured luminance profile and a measured color coordinate profile of the display device at the maximum gray level based on the measured tristimulus data at the maximum gray level;

determining a target color coordinate profile of the display device at the maximum gray level based on the measured color coordinate profile;

obtaining a measured red maximum luminance, a measured green maximum luminance and a measured blue maximum luminance of each pixel in the display device;

determining a maximum target luminance of the each pixel which allows a red luminance, a green luminance and a blue luminance of the each pixel converted from the maximum target luminance and a target color coordinate of the each pixel at the maximum gray level to become lower than or equal to the measured red maximum luminance, the measured green maximum luminance and the measured blue maximum luminance of the each pixel, respectively;

determining a final target luminance profile of the display device at the maximum gray level based on the measured luminance profile and the maximum target luminance of the each pixel; and storing the correction data at the maximum gray level in the display device by generating the correction data at the maximum gray level based on the final target luminance profile and the target color coordinate profile at the maximum gray level, wherein the determining the maximum target luminance of the each pixel includes:

obtaining target luminance and color coordinate data of the each pixel by setting the maximum target luminance of the each pixel to a variable a and by obtaining the target color coordinate of the each pixel from the target color coordinate profile;

converting the target luminance and color coordinate data of the each pixel to target tristimulus data of the each pixel;

converting the target tristimulus data of the each pixel to the red luminance, the green luminance and the blue luminance of the each pixel by an XYZ-to-YrYgYb conversion matrix; and determining the variable a which allows the red luminance, the green luminance and the blue luminance of the each pixel to become lower than or equal to the measured red maximum luminance, the measured green maximum luminance and the measured blue maximum luminance of the each pixel, respectively.

2. The method of claim 1, wherein the correction data at the maximum gray level have correction values lower than or equal to 0.

3. The method of claim 1, wherein obtaining the measured tristimulus data at the maximum gray level includes:

providing white maximum gray data to the display device; and obtaining the measured tristimulus data at the maximum gray level by capturing a white image displayed by the display device based on the white maximum gray data.

4. The method of claim 1, wherein obtaining the measured luminance profile and the measured color coordinate profile at the maximum gray level includes:

converting the measured tristimulus data at the maximum gray level to luminance and color coordinate data in a luminance and color coordinate domain;

obtaining the measured luminance profile based on luminance data among the luminance and color coordinate data;

obtaining a measured x-color coordinate profile based on x-color coordinate data among the luminance and color coordinate data; and obtaining a measured y-color coordinate profile based on y-color coordinate data among the luminance and color coordinate data.

5. The method of claim 4, wherein the determining the target color coordinate profile at the maximum gray level includes:

determining a target x-color coordinate profile by calculating a moving average for the measured x-color coordinate profile; and determining a target y-color coordinate profile by calculating a moving average for the measured y-color coordinate profile.

6. The method of claim 1, wherein the obtaining the measured red maximum luminance, the measured green maximum luminance and the measured blue maximum luminance of the each pixel includes:

providing red maximum gray data to the display device;

obtaining the measured tristimulus data at a red maximum gray level by capturing a red image displayed by the display device based on the red maximum gray data;

obtaining the measured red maximum luminance of the each pixel from the measured tristimulus data at the red maximum gray level;

providing green maximum gray data to the display device;

obtaining the measured tristimulus data at a green maximum gray level by capturing a green image displayed by the display device based on the green maximum gray data;

obtaining the measured green maximum luminance of the each pixel from the measured tristimulus data at the green maximum gray level;

providing blue maximum gray data to the display device;

obtaining the measured tristimulus data at a blue maximum gray level by capturing a blue image displayed by the display device based on the blue maximum gray data; and obtaining the measured blue maximum luminance of the each pixel from the measured tristimulus data at the blue maximum gray level.

7. The method of claim 1, wherein the XYZ-to-YrYgYb conversion matrix is:

$$\begin{bmatrix} \frac{W_{xR}}{W_{yR}} & \frac{W_{xG}}{W_{yG}} & \frac{W_{xB}}{W_{yB}} \\ 1 & 1 & 1 \\ \frac{W_{zR}}{W_{yR}} & \frac{W_{zG}}{W_{yG}} & \frac{W_{zB}}{W_{yB}} \end{bmatrix}^{-1},$$

where $W_{xR}$ represents an x-color coordinate value of a red image of the each pixel, $W_{yR}$ represents a y-color coordinate value of the red image of the each pixel, $W_{zR}$ is calculated by subtracting the x-color coordinate value and the y-color coordinate value of the red image of the each pixel from 1, $W_{xG}$ represents an x-color coordinate value of a green image of the each pixel, $W_{yG}$ represents a y-color coordinate value of the green image of the each pixel, $W_{zG}$ is calculated by subtracting the x-color coordinate value and the y-color coordinate value of the green image of the each pixel from 1, $W_{xB}$ represents an x-color coordinate value of a blue image of the each pixel, $W_{yB}$ represents a y-color coordinate value of the blue image of the each pixel, and $W_{zB}$ is calculated by subtracting the x-color coordinate value and the y-color coordinate value of the blue image of the each pixel from 1.

8. The method of claim 1, wherein the maximum target luminance of the each pixel is determined using an equation:

$$\begin{bmatrix} \frac{W_{xR}}{W_{yR}} & \frac{W_{xG}}{W_{yG}} & \frac{W_{xB}}{W_{yB}} \\ 1 & 1 & 1 \\ \frac{W_{zR}}{W_{yR}} & \frac{W_{zG}}{W_{yG}} & \frac{W_{zB}}{W_{yB}} \end{bmatrix}^{-1} \begin{bmatrix} \frac{W_{x'255}}{W_{y'255}} \cdot \alpha \\ \alpha \\ \frac{W_{z'255}}{W_{y'255}} \cdot \alpha \end{bmatrix} \leq \begin{bmatrix} Y_{R255} \\ Y_{G255} \\ Y_{B255} \end{bmatrix},$$

where $\alpha$ represents the maximum target luminance of the each pixel, $W_{x'255}$ represents an x-color coordinate value of the target color coordinate of the each pixel, $W_{y'255}$ represents a y-color coordinate value of the target color coordinate of the each pixel, $W_{z'255}$ is calculated by subtracting the x-color coordinate value and the y-color coordinate value of the target color coordinate of the each pixel from 1, $Y_{R255}$ represents the measured red maximum luminance, $Y_{G255}$ represents the measured green maximum luminance, $Y_{B255}$ represents the measured blue maximum luminance, $W_{xR}$ represents an x-color coordinate value of a red image of the each pixel, $W_{yR}$ represents a y-color coordinate value of the red image of the each pixel, $W_{zR}$ is calculated by subtracting the x-color coordinate value and the y-color coordinate value of the red image of the each pixel from 1, $W_{xG}$ represents an x-color coordinate value of a green image of the each pixel, $W_{yG}$ represents a y-color coordinate value of the green image of the each pixel, $W_{zG}$ is calculated by subtracting the x-color coordinate value and the y-color coordinate value of the green image of the each pixel from 1, $W_{xB}$ represents an x-color coordinate value of a blue image of the each pixel, $W_{yB}$ represents a y-color coordinate value of the blue image of the each pixel, and $W_{zB}$ is calculated by subtracting the x-color coordinate value and the y-color coordinate value of the blue image of the each pixel from 1.

9. The method of claim 1, wherein the determining the final target luminance profile at the maximum gray level includes:

determining an intermediate target luminance profile by calculating a moving average for the measured luminance profile at the maximum gray level; and determining the final target luminance profile at the maximum gray level by adjusting the intermediate target luminance profile to become lower than or equal to the maximum target luminance of the each pixel.

10. The method of claim 1, wherein storing the correction data at the maximum gray level in the display device includes:

calculating a target red luminance, a target blue luminance and a target green luminance of the each pixel based on the final target luminance profile and the target color coordinate profile at the maximum gray level;

obtaining a target red gray level, a target green gray level and a target blue gray level respectively corresponding to the target red luminance, the target blue luminance and the target green luminance of the each pixel; and storing, as the correction data at the maximum gray level, a value generated by subtracting a maximum red gray level from the target red gray level, a value generated by subtracting a maximum green gray level from the target green gray level and a value generated by subtracting a maximum blue gray level from the target blue gray level in the display device.

11. The method of claim 1, further comprising:

obtaining the final target luminance profile at at least one reference gray level lower than the maximum gray level by applying a reduction ratio of an average of the final target luminance profile at the maximum gray level to an average of the measured luminance profile at the maximum gray level to an intermediate target luminance profile at the at least one reference gray level; and storing the correction data at the at least one reference gray level in the display device by generating the correction data at the at least one reference gray level based on the final target luminance profile at the at least one reference gray level.

12. The method of claim 11, further comprising:

obtaining the measured tristimulus data at the at least one reference gray level by capturing an image at the at least one reference gray level lower than the maximum gray level displayed by the display device;

obtaining the measured luminance profile and the measured color coordinate profile at the at least one reference gray level based on the measured tristimulus data at the at least one reference gray level; and determining the intermediate target luminance profile at the at least one reference gray level by calculating a moving average for the measured luminance profile at the at least one reference gray level and the target color coordinate profile at the at least one reference gray level by calculating a moving average for the measured color coordinate profile at the at least one reference gray level, wherein the correction data at the at least one reference gray level are determined based on the final target luminance profile and the target color coordinate profile at the at least one reference gray level.

13. A display device comprising:

a display panel including pixels;

a correction data memory which stores correction data at a plurality of reference gray levels including a maximum gray level;

a data corrector which corrects image data based on the correction data;

a controller which performs a dithering operation based on the corrected image data to output dithered image data; and a data driver which generates data signals based on the dithered image data output from the controller, and provides the data signals to the pixels, wherein the correction data at the maximum gray level have correction values lower than or equal to 0, wherein measured tristimulus data of the display device at the maximum gray level are obtained by capturing a white image at the maximum gray level displayed by the display device, wherein a measured luminance profile and a measured color coordinate profile of the display device at the maximum gray level are obtained based on the measured tristimulus data at the maximum gray level, wherein a target color coordinate profile of the display device at the maximum gray level is determined based on the measured color coordinate profile, wherein a measured red maximum luminance, a measured green maximum luminance and a measured blue maximum luminance of each pixel in the display device are obtained, wherein a maximum target luminance of the each pixel is determined such that a red luminance, a green luminance and a blue luminance of the each pixel converted from the maximum target luminance and a target color coordinate of the each pixel at the maximum gray level become lower than or equal to the measured red maximum luminance, the measured green maximum luminance and the measured blue maximum luminance of the each pixel, respectively, wherein a final target luminance profile of the display device at the maximum gray level is determined based on the measured luminance profile and the maximum target luminance of the each pixel, wherein the correction data at the maximum gray level are generated based on the final target luminance profile and the target color coordinate profile at the maximum gray level, wherein target luminance and color coordinate data of the each pixel are obtained by setting the maximum target luminance of the each pixel to a variable a and by obtaining the target color coordinate of the each pixel from the target color coordinate profile, wherein the target luminance and color coordinate data of the each pixel are converted to target tristimulus data of the each pixel, wherein the target tristimulus data of the each pixel are converted to the red luminance, the green luminance and the blue luminance of the each pixel by an XYZ-to-YrYgYb conversion matrix, and wherein the variable $\alpha$ is determined such that the red luminance, the green luminance and the blue luminance of the each pixel become lower than or equal to the measured red maximum luminance, the measured green maximum luminance and the measured blue maximum luminance of the each pixel, respectively.

14. The display device of claim 13, wherein the XYZ-to-YrYgYb conversion matrix is:

$$\begin{bmatrix} \frac{W_{xR}}{W_{yR}} & \frac{W_{xG}}{W_{yG}} & \frac{W_{xB}}{W_{yB}} \\ 1 & 1 & 1 \\ \frac{W_{zR}}{W_{yR}} & \frac{W_{zG}}{W_{yG}} & \frac{W_{zB}}{W_{yB}} \end{bmatrix}^{-1},$$

where $W_{xR}$ represents an x-color coordinate value of a red image of the each pixel, $W_{yR}$ represents a y-color coordinate value of the red image of the each pixel, $W_{zR}$ is calculated by subtracting the x-color coordinate value and the y-color coordinate value of the red image of the each pixel from 1, $W_{xG}$ represents an x-color coordinate value of a green image of the each pixel, $W_{yG}$ represents a y-color coordinate value of the green image of the each pixel, $W_{zG}$ is calculated by subtracting the x-color coordinate value and the y-color coordinate value of the green image of the each pixel from 1, $W_{xB}$ represents an x-color coordinate value of a blue image of the each pixel, $W_{yB}$ represents a y-color coordinate value of the blue image of the each pixel, and $W_{zB}$ is calculated by subtracting the x-color coordinate value and the y-color coordinate value of the blue image of the each pixel from 1.

15. The display device of claim 13, wherein the maximum target luminance of the each pixel is determined using an equation:

$$\begin{bmatrix} \frac{W_{xR}}{W_{yR}} & \frac{W_{xG}}{W_{yG}} & \frac{W_{xB}}{W_{yB}} \\ 1 & 1 & 1 \\ \frac{W_{zR}}{W_{yR}} & \frac{W_{zG}}{W_{yG}} & \frac{W_{zB}}{W_{yB}} \end{bmatrix}^{-1} \begin{bmatrix} \frac{W_{x'255}}{W_{y'255}} \cdot \alpha \\ \alpha \\ \frac{W_{z'255}}{W_{y'255}} \cdot \alpha \end{bmatrix} \leq \begin{bmatrix} Y_{R255} \\ Y_{G255} \\ Y_{B255} \end{bmatrix},$$

where $\alpha$ represents the maximum target luminance of the each pixel, $W_{x'255}$ represents an x-color coordinate value of the target color coordinate of the each pixel, $W_{y'255}$ represents a y-color coordinate value of the target color coordinate of the each pixel, $W_{z'255}$ is calculated by subtracting the x-color coordinate value and the y-color coordinate value of the target color coordinate of the each pixel from 1, $Y_{R255}$ represents the measured red maximum luminance, $Y_{G255}$ represents the measured green maximum luminance, $Y_{B255}$ represents the measured blue maximum luminance, $W_{xR}$ represents an x-color coordinate value of a red image of the each pixel, $W_{yR}$ represents a y-color coordinate value of the red image of the each pixel, $W_{zR}$ is calculated by subtracting the x-color coordinate value and the y-color coordinate value of the red image of the each pixel from 1, $W_{xG}$ represents an x-color coordinate value of a green image of the each pixel, $W_{yG}$ represents a y-color coordinate value of the green image of the each pixel, $W_{zG}$ is calculated by subtracting the x-color coordinate value and the y-color coordinate value of the green image of the each pixel from 1, $W_{xB}$ represents an x-color coordinate value of a blue image of the each pixel, $W_{yB}$ represents a y-color coordinate value of the blue image of the each pixel, and $W_{zB}$ is calculated by subtracting the x-color coordinate value and the y-color coordinate value of the blue image of the each pixel from 1.

16. The display device of claim 13, wherein the correction data include a plurality of correction values at a plurality of sampling positions, and wherein, with respect to each pixel, the data corrector corrects the image data for the each pixel by performing a bilinear interpolation on the plurality of correction values at four sampling points adjacent to the each pixel among the plurality of sampling positions.

17. The display device of claim 13, wherein, with respect to each pixel, the data corrector corrects the image data for the each pixel by performing a linear interpolation on the plurality of correction values at two reference gray levels adjacent to a gray level of the image data for the each pixel among the plurality of reference gray levels.

* * * * *